US007230382B2

(12) United States Patent
Horiuchi et al.

(10) Patent No.: US 7,230,382 B2
(45) **Date of Patent: *Jun. 12, 2007**

(54) HIGH PRESSURE MERCURY LAMP WITH VENTED REFLECTOR AND IMAGE PROJECTION APPARATUS

(75) Inventors: Makoto Horiuchi, Nara (JP); Kiyoshi Takahashi, Kyoto (JP); Shinichiro Hataoka, Osaka (JP); Tsuyoshi Ichibakase, Osaka (JP); Tomoyuki Seki, Osaka (JP); Takashi Tsutatani, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 191 days.

This patent is subject to a terminal disclaimer.

(21) Appl. No.: 10/828,493

(22) Filed: Apr. 20, 2004

(65) Prior Publication Data

US 2004/0207306 A1 Oct. 21, 2004

(30) Foreign Application Priority Data

Apr. 21, 2003 (JP) ..... 2003-115538

(51) Int. Cl.
*H01J 17/18* (2006.01)
*H01J 5/16* (2006.01)

(52) U.S. Cl. ..... 313/623; 313/594; 362/345

(58) Field of Classification Search ..... 313/12, 313/113, 594, 623; 362/345
See application file for complete search history.

(56) References Cited

U.S. PATENT DOCUMENTS

| | | | | |
|---|---|---|---|---|
| 3,688,149 | A * | 8/1972 | Pitkjaan | 313/114 |
| 6,509,674 | B1 * | 1/2003 | Nakagawa | 313/113 |
| 6,831,414 | B2 * | 12/2004 | Van Erk et al. | 313/623 |
| 6,844,679 | B1 * | 1/2005 | Horiuchi et al. | 313/642 |
| 6,890,236 | B2 * | 5/2005 | Hataoka et al. | 445/26 |
| 6,919,686 | B2 * | 7/2005 | Okamoto et al. | 313/594 |
| 6,965,202 | B2 * | 11/2005 | Hataoka et al. | 313/623 |
| 2002/0017842 | A1 * | 2/2002 | Narita | 313/13 |
| 2003/0102805 | A1 * | 6/2003 | Hataoka et al. | 313/623 |

FOREIGN PATENT DOCUMENTS

| | | | |
|---|---|---|---|
| JP | 02-148561 | | 6/1990 |
| JP | WO0129862 | * | 4/2001 |

* cited by examiner

*Primary Examiner*—Edward J. Glick
*Assistant Examiner*—Anastasia S. Midkiff
(74) *Attorney, Agent, or Firm*—Harness, Dickey & Pierce, P.L.C.

(57) ABSTRACT

A lamp with a reflector comprises a high pressure discharge lamp and a reflector. The reflector has a first opening and a second opening. Clearance between a sealing portion of the high pressure discharge lamp and the second opening is substantially filled. The sealing portion includes a first glass portion extending from a luminous bulb and a second glass portion provided in the inside of the first glass portion, and the sealing portion has a portion to which a compressive stress is applied. Moreover, when the sealing portion is disposed to extend in a substantially horizontal direction, a portion of the reflector is formed with an air inlet for introducing an air flow striking against an upper portion of the luminous bulb 1 and then coming into a lower portion of the luminous bulb 1.

26 Claims, 14 Drawing Sheets

Compressive stress remains

HIGH PRESSURE MERCURY LAMP WITH VENTED REFLECTOR AND IMAGE PROJECTION APPARATUS

BACKGROUND OF THE INVENTION

1. Field of the Invention

The present invention relates to lamps with reflectors and image projection apparatuses. In particular, the present invention relates to high pressure mercury lamps used as light sources for projectors or the like and having relatively large amounts of mercury enclosed.

2. Description of the Related Art

In recent years, image projection apparatuses such as a liquid crystal projector and a DMD™ (Digital Micromirror Device) projector have been widely used as systems for realizing large-scale video images. For such an image projection apparatus, in general, a high pressure mercury lamp has been commonly used which is disclosed, for example, in Japanese Unexamined Patent Publication No. 2-148561.

FIG. 1 shows the construction of a high pressure mercury lamp disclosed in Japanese Unexamined Patent Publication No. 2-148561. The lamp 1000 shown in FIG. 1 is composed of a luminous bulb 1 mainly made of quartz and a pair of side tube portions (sealing portions) 2 extending from both sides of the luminous bulb 1. In each of the side tube portions 2, an electrode structure made of metal is embedded, whereby power can be supplied from the outside to the luminous bulb 1. The electrode structure has an electrode 3 of tungsten (W), a molybdenum (Mo) foil 4, and an external lead 5, which are electrically connected in the listed order. A coil 12 is wound around the tip of the electrode 3. The luminous bulb 1 encloses mercury (Hg) and argon (Ar) as luminous species, and a smaller amount of halogen gas (not shown).

The principle of operation of the lamp 1000 will be described briefly. When a starting voltage is applied to respective ends of the pair of external leads 5, Ar discharge occurs and the temperature within the luminous bulb 1 is raised. This temperature rise evaporates Hg atoms, and the evaporated atoms in gaseous form fill the inside of the luminous bulb 1. Hg between both the electrodes 3 is exited by electrons emitted from one of the electrodes 3, and then becomes luminescent. Therefore, as the vapor pressure of Hg serving as a luminous species is higher, light with higher intensity is emitted. Moreover, as the vapor pressure of Hg is higher, the potential difference (the voltage) between the electrodes increases. Therefore, when lamps are operated at the same rated power, current flowing in a lamp with a higher Hg vapor pressure can be lower than that with a lower Hg vapor pressure. This means that a load on the electrode 3 can be lightened, which contributes to life extension of the lamp. Consequently, as the Hg vapor pressure is higher, a lamp with more excellent property in intensity and durability can be provided.

SUMMARY OF THE INVENTION

From the viewpoint of the physical lamp strength against vapor pressure, conventional high pressure mercury lamps, however, are practically used at an Hg vapor pressure of about 15 to 20 MPa (150 to 200 atm). Japanese Unexamined Patent Publication No. 2-148561 discloses an ultrahigh pressure mercury lamp with an Hg vapor pressure of 200 to 350 bars (corresponding to about 20 to about 35 MPa). However, when put into practical use in consideration of its reliability, life or the like, the lamp is operated at an Hg vapor pressure of about 15 to 20 MPa (150 to 200 atm).

Currently, research and development has been conducted aiming to increase the lamp strength against pressure, but no report has been made to date on a high pressure mercury lamp with a high vapor pressure resistance which can withstand an Hg vapor pressure of more than 20 MPa. Under such a circumstance, the inventors successfully fabricated a high pressure mercury lamp with a high vapor pressure resistance of about 30 to 40 MPa or higher (about 300 to 400 atm or higher), which is disclosed in U.S. patent application Publications No. 2003/0102805 A1 and No. 2003/0168980 A1.

Since the high pressure mercury lamp with an extremely high vapor pressure resistance is operated at an Hg vapor pressure that was unattainable in conventional techniques, the characteristics and the behaviors of the lamp cannot be predicted. When the inventors conducted a burning test of the high pressure mercury lamp, it was found that the lamp blackens when the operating pressure exceeds the conventional limit value, 20 MPa, and in particular exceeds about 30 MPa.

The present invention has been made in view of the foregoing problem, and its main object is to provide a lamp with a reflector capable of suppressing blackening of a high pressure mercury lamp of an operating pressure above 20 MPa (for example, 23 MPa or higher, or in particular 25 MPa or higher (or 27 MPa or higher, or 30 MPa or higher)).

A lamp with a reflector of the present invention comprises: a high pressure discharge lamp including a luminous bulb with a luminous substance enclosed therein and a pair of sealing portions extending from the luminous bulb; and a reflector for reflecting light emitted from the high pressure discharge lamp. The reflector has a first opening located in a forward position of the reflector with respect to a light emission direction, the reflector is formed with a second opening into which one of the pair of sealing portions is inserted, and clearance between the one said sealing portion and the second opening is substantially filled. At least one of the pair of sealing portions includes a first glass portion extending from the luminous bulb and a second glass portion provided in at least a portion of the inside of the first glass portion, and the at least one said sealing portion has a portion to which a compressive stress is applied. When the pair of sealing portions are disposed to extend in the substantially horizontal direction, a portion of the reflector is formed with an air inlet for introducing an air flow striking against an upper portion of the luminous bulb and then coming into a lower portion of the luminous bulb.

In one preferred embodiment, the high pressure discharge lamp is a high pressure mercury lamp, and mercury is enclosed as the luminous substance in an amount of 230 $mg/cm^3$ or more based on the internal volume of the luminous bulb.

Another lamp with a reflector of the present invention comprises: a high pressure mercury lamp including a luminous bulb with at least mercury enclosed therein and a pair of sealing portions extending from the luminous bulb; and a reflector for reflecting light emitted from the high pressure mercury lamp. The reflector has a first opening located in a forward position of the reflector with respect to a light emission direction, the reflector is formed with a second opening into which one of the pair of sealing portions is inserted, and clearance between the one said sealing portion and the second opening is substantially filled. Each of the pair of sealing portions includes a first glass portion extending from the luminous bulb and a second glass portion provided in at least a portion of the inside of the first glass portion, and both the pair of sealing portions have portions to which a compressive stress is applied. When the pair of sealing portions are disposed to extend in the substantially horizontal direction, an air inlet is formed in a region of the reflector located below the sealing portion and in front of the luminous bulb with respect to the light emission direction, and an air vent is formed in a region of the reflector located above the sealing portion and in front of the luminous bulb with respect to the light emission direction. A duct for passing air is coupled to the air inlet.

In one preferred embodiment, the duct and the air inlet are arranged so that at least part of air introduced from the duct via the air inlet strikes against and reflects from a region of the reflector positioned above the sealing portion, the reflected air touches the upper portion of the luminous bulb, and then the air moves to the lower portion of the luminous bulb.

Preferably, a concave lens is further attached to a position of the reflector located in front of the first opening with respect to the light emission direction.

In one preferred embodiment, at least mercury is enclosed as the luminous substance in the luminous bulb. The amount of the enclosed mercury is 270 mg/cm$^3$ or more based on the internal volume of the luminous bulb. Halogen is enclosed in the luminous bulb. The lamp has a bulb wall load of 80 W/cm$^2$ or more.

In one preferred embodiment, the amount of the enclosed mercury is 300 mg/cm$^3$ or more based on the internal volume of the luminous bulb.

In one preferred embodiment, in the luminous bulb, electrode rods are opposed to each other. Each of the electrode rods is connected to a metal foil. The metal foil is provided in the sealing portion and at least a portion of the metal foil is positioned in the second glass portion.

In one preferred embodiment, a coil at least the surface of which contains at least one metal selected from the group consisting of Pt, Ir, Rh, Ru, and Re is wound around at least part of a portion of the electrode rod embedded in the sealing portion.

In one preferred embodiment, a metal portion which comes into contact with the second glass portion and which is used for supply of power is provided in the sealing portion. The compressive stress is applied in at least the longitudinal direction of the sealing portion. The first glass portion contains 99 wt % or more of $SiO_2$. The second glass portion contains $SiO_2$ and at least one of 15 wt % or less of $Al_2O_3$ and 4 wt % or less of B.

In one preferred embodiment, the compressive stress in a region of the sealing portion corresponding to the second glass portion is from 10 kgf/cm$^2$ to 50 kgf/cm$^2$ inclusive when the sealing portion is measured by a sensitive color plate method utilizing the photoelastic effect.

A still another lamp with a reflector of the present invention comprises: a high pressure mercury lamp including a luminous bulb with mercury enclosed therein and a pair of sealing portions extending from the luminous bulb; and a reflector for reflecting light emitted from the high pressure mercury lamp. The reflector has a first opening located in a forward position of the reflector with respect to a light emission direction, the reflector is formed with a second opening into which one of the pair of sealing portions is inserted, and clearance between the one said sealing portion and the second opening is substantially filled. The luminous bulb of the high pressure mercury lamp encloses mercury in an amount of 270 mg/cm$^3$ or more based on the internal volume of the luminous bulb. The high pressure mercury lamp has a bulb wall load of 80 W/cm$^2$ or more. When the pair of sealing portions are disposed to extend in the substantially horizontal direction, an air inlet is formed in a region of the reflector located below the sealing portion and in front of the luminous bulb with respect to the light emission direction, and an air vent is formed in a region of the reflector located above the sealing portion and in front of the luminous bulb with respect to the light emission direction. A duct for passing air is coupled to the air inlet.

In one preferred embodiment, the duct and the air inlet are arranged so that at least part of air introduced from the duct via the air inlet strikes against and reflects from a region of the reflector positioned above the sealing portion, the reflected air touches the upper portion of the luminous bulb, and then the air moves to the lower portion of the luminous bulb. The reflector is an elliptical mirror. A concave lens is attached to a position of the reflector located in front of the first opening with respect to the light emission direction.

Preferably, a trigger line is wound around at least one of the pair of sealing portions.

An image projection apparatus of the present invention comprises: the lamp with a reflector described above; and an optical system using the lamp with a reflector as a light source.

A high pressure mercury lamp in one embodiment includes a luminous bulb within which a pair of electrodes are opposed and a sealing portion which extends from the luminous bulb and within which a portion of the electrode is contained. A metal film made of at least one metal selected from the group consisting of Pt, Ir, Rh, Ru, and Re is formed on at least part of the surface of a portion of the electrode positioned in the sealing portion.

In one embodiment, the electrode is connected by welding to a metal foil provided in the sealing portion, and the metal film is formed on not a connection point to the metal foil but the surface of the portion of the electrode embedded in the sealing portion. A portion of metal forming the metal film may be present within the luminous bulb. The metal film preferably has a multilayer structure in which the lower layer is an Au layer and the upper layer is a Pt layer.

A high pressure mercury lamp in one embodiment includes a luminous bulb within which a pair of electrodes are opposed and a sealing portion which extends from the luminous bulb and within which a portion of the electrode is contained. A coil the surface of which contains at least one metal selected from the group consisting of Pt, Ir, Rh, Ru, and Re is wound around a portion of the electrode positioned in the sealing portion. In one embodiment, portions of the metal foil and the electrode are embedded in the sealing portion, and a coil the surface of which contains at least one metal selected from the group consisting of Pt, Ir, Rh, Ru, and Re is wound around a portion of the electrode embedded in the sealing portion. The surface of the coil preferably has a metal film of a multilayer structure in which the lower layer is an Au layer and the upper layer is a Pt layer.

A high pressure mercury lamp in one embodiment includes a luminous bulb with a luminous substance enclosed therein and a sealing portion for retaining the airtightness of the luminous bulb. The sealing portion includes a first glass portion extending from the luminous bulb and a second glass portion provided in at least a portion of the inside of the first glass portion, and the sealing portion has a portion to which a compressive stress is applied. The portion to which a compressive stress is applied is selected from the group consisting of the second glass portion, the boundary portion between the second glass portion and the first glass portion, a portion of the second glass portion closer to the first glass portion, and a portion of the first glass portion closer to the second glass portion. In one embodiment, a strain boundary region caused by the difference in compressive stress between the first glass portion and the second glass portion is present in the vicinity of the boundary between the two glass portions. A metal portion which comes into contact with the second glass portion and which is used for supply of power is preferably provided within the sealing portion. The compressive stress need only be applied in at least the longitudinal direction of the sealing portion.

In one embodiment, the first glass portion contains 99 wt % or more of $SiO_2$, the second glass portion contains $SiO_2$ and at least one of 15 wt % or less of $Al_2O_3$ and 4 wt % or less of B, and the second glass portion has a lower softening point than the first glass portion. It is preferable that the second glass portion be a glass portion formed from a glass tube. Moreover, it is preferable that the second glass portion be not a glass portion formed by compressing glass powder and sintering the compressed material. In one embodiment, in the portion to which a compressive stress is applied, the stress value is from about 10 kgf/cm$^2$ to about 50 kgf/cm$^2$, or the difference in the compressive stress between the two portions is from about 10 kgf/cm$^2$ to about 50 kgf/cm$^2$.

In one embodiment, in the luminous bulb, a pair of electrode rods are opposed to each other. At least one of the pair of electrode rods is connected to a metal foil. The metal foil is provided in the sealing portion and at least a portion of the metal foil is positioned in the second glass portion. As the luminous substance, at least mercury is enclosed in the luminous bulb. The amount of the enclosed mercury is 300 mg/cc or more. The high pressure mercury lamp has an average color rendering index Ra above 65. The high pressure mercury lamp preferably has a color temperature of 8000 K or greater.

DETAILED DESCRIPTION OF THE PREFERRED EMBODIMENTS

Prior to description of embodiments of the present invention, a description will first be made of high pressure mercury lamps with an extremely high vapor pressure resistance which have an operating pressure of about 30 to 40 MPa or higher (about 300 to 400 atm or higher). Note that the details on these high pressure mercury lamps are disclosed in U.S. Patent Application Publications No. 2003/0102805 A1 and No. 2003/0168980 A1, the contents of which are incorporated herein by reference.

Figure 2A:
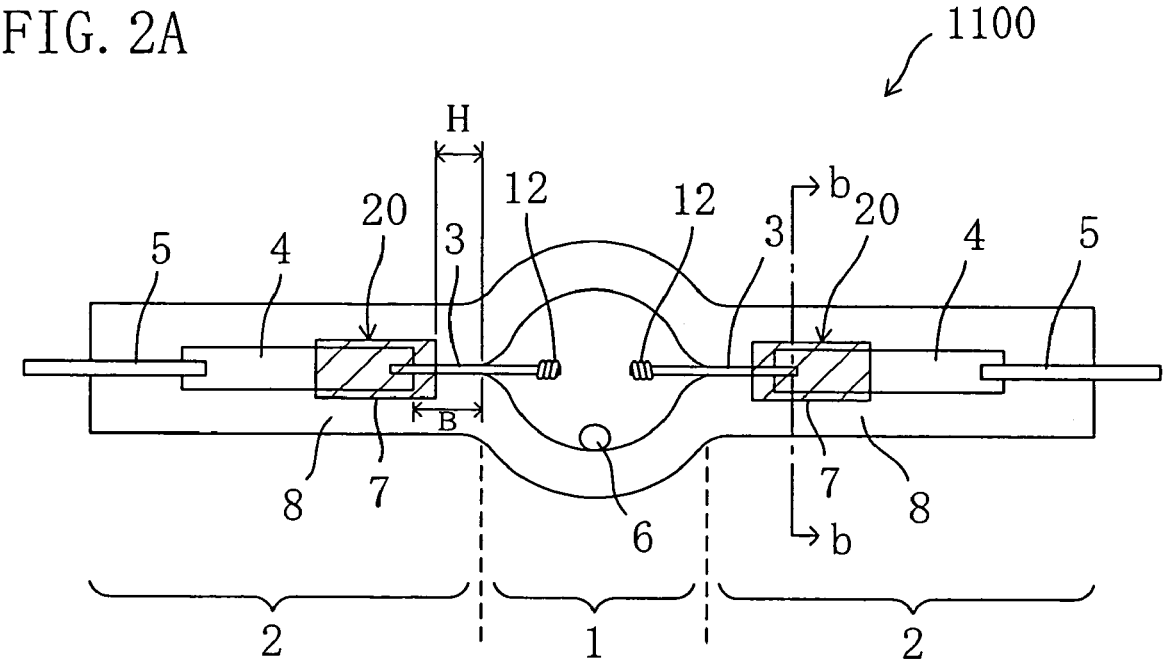
FIGS. 2A and 2B are schematic views showing the structure of a high pressure discharge lamp 1100.
Figure 2B:
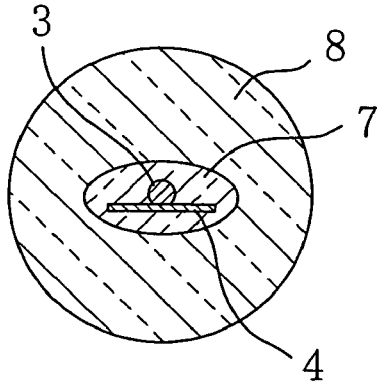

It was very tough work to develop a practically usable high pressure mercury lamp even with an operating pressure of about 30 MPa or higher. However, for example, by employing a structure shown in FIG. 2, the inventors successfully attained a lamp with extremely high vapor pressure resistance. FIG. 2B is a cross-sectional view take along the line b-b of FIG. 2A.

A high pressure mercury lamp 1100 shown in FIG. 2 is disclosed in U.S. patent application Publications above mentioned. The lamp 1100 includes a luminous bulb 1 and a pair of sealing portions 2 for retaining the airtightness of the luminous bulb 1. At least one of the sealing portions 2 includes a first glass portion 8 extending from the luminous bulb 1 and a second glass portion 7 provided in at least a portion of the inside of the first glass portion 8. The one said sealing portion 2 has a portion (20) to which a compressive stress is applied.

The first glass portion 8 in the sealing portion 2 contains 99 wt % or more of silica ($SiO_2$), and is made of, for example, quartz glass. On the other hand, the second glass portion 7 contains $SiO_2$ (the percentage of $SiO_2$ is less than 99 wt %) and at least one of 15 wt % or less of alumina ($Al_2O_3$) and 4 wt % or less of boron (B), and is made of, for example, Vycor® glass. When $Al_2O_3$ or B is added to $SiO_2$, the glass softening point is decreased. Therefore, the softening point of the second glass portion 7 is lower than that of the first glass portion 8. Vycor glass (trade name) is a material obtained by mixing additives in quartz glass to decrease the softening point, and thereby has an improved processability over quartz glass. The composition of the Vycor glass is as follows: 96.5 wt % of $SiO_2$; 0.5 wt % of $Al_2O_3$; and 3 wt % of B. In this embodiment, the second glass portion 7 is formed from a glass tube made of Vycor glass. The glass tube made of Vycor glass can be replaced by a glass tube containing 62 wt % of $SiO_2$, 13.8 wt % of $Al_2O_3$, and 23.7 wt % of CuO.

The compressive stress applied to a portion of the sealing portion 2 can be substantially beyond zero (i.e., 0 kgf/cm$^2$). The presence of the compressive stress can improve the strength against pressure as compared to the conventional structure. It is preferable that the compressive stress be about 10 kgf/cm$^2$ or more, (about $9.8\times10^5$ N/m$^2$ or more) and about 50 kgf/cm$^2$ or less, (about $4.9\times10^6$ N/m$^2$ or less). When it is less than 10 kgf/cm$^2$, the compressive strain is so weak that the strength of the lamp against pressure may not be increased sufficiently. Moreover, there is no practical glass material that can realize a structure having a compressive stress higher than about 50 kgf/cm$^2$. However, a compressive stress of less than 10 kgf/cm$^2$ can increase the vapor pressure resistance as compared to the conventional structure as long as it exceeds substantially zero. If a practical material that can realize a structure having a compressive stress of more than 50 kgf/cm$^2$ is developed, the second glass portion 7 can have a compressive stress of more than 50 kgf/cm$^2$.

The principle of strain measurement by a sensitive color plate method utilizing the photoelastic effect will be described briefly with reference to FIG. 11. FIGS. 11A and 11B are schematic views showing the state in which linearly polarized light obtained by transmitting light through a polarizing plate is incident to glass. Herein, when the linearly polarized light that is incident is represented as u, u can be regarded as being obtained by synthesizing two linearly polarized lights u1 and u2 perpendicularly intersecting each other.

Figure 11A:
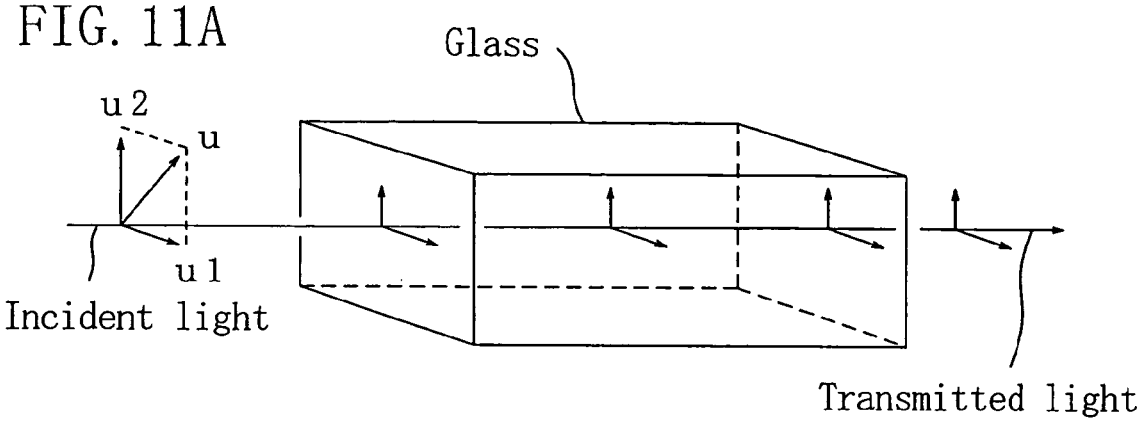
FIGS. 11A and 11B are drawings for explaining the principle of measurement of strain by a sensitive color plate method utilizing the photoelastic effect.
Figure 11B:
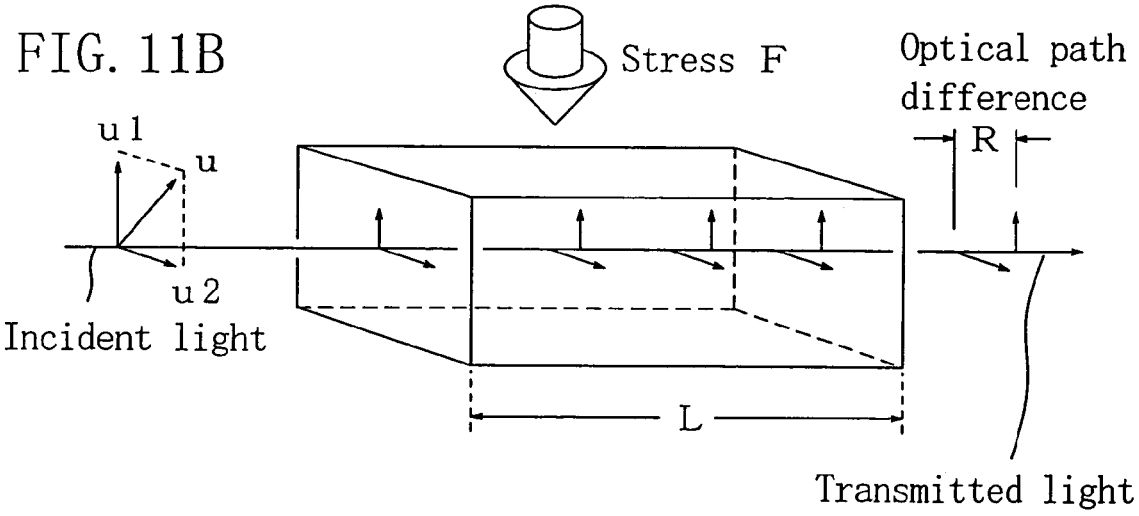

As shown in FIG. 11A, if there is no strain in the glass, u1 and u2 are transmitted through it at the same speed, after which no displacement occurs between the transmitted u1 and u2. On the other hand, as shown in FIG. 11B, if there is a strain in the glass and a stress F is applied thereto, u1 and u2 are transmitted through it at different speeds, after which a displacement occurs between the transmitted u1 and u2. In other words, one of u1 and u2 is later than the other. The distance of this difference made by being late is referred to as an optical path difference. Since the optical path difference R is proportional to the stress F and the distance L of light transmission through the glass, the optical path difference R can be expressed as $$R=C\cdot F\cdot L$$

where C is a proportional constant. The unit of each letter is as follows: R (nm); F (kgf/cm$^2$); L (cm); and C ({nm/cm}/{kgf/cm$^2$}). C is referred to as "photoelastic constant" and depends on the materials used such as glass. As seen from the above equation, if C is known, L and R can be measured to obtain F.

The inventors measured the distance L of light transmission in the sealing portion 2, that is, the outer diameter L of the sealing portion 2, and obtained the optical path difference R by observing the color of the sealing portion 2 at the time of measurement with a strain standard. The photoelastic constant of quartz glass, which is 3.5, was used as the photoelastic constant C. These values were substituted in the above equation to calculate the stress value, and the compressive strain in the longitudinal direction of a metal foil 4 was quantified with the calculated stress value.

In this measurement, stress in the longitudinal direction (direction in which the axis of an electrode rod 3 extends) of the sealing portion 2 was observed, but this does not mean that there is no compressive stress in other directions. In order to determine whether or not a compressive stress is present in the radial direction (the direction from the central axis toward the outer circumference, or the opposite direction) or the circumferential direction (e.g., the clockwise direction) of the sealing portion 2, it is necessary to cut the luminous bulb 1 or the sealing portion 2. However, as soon as such cutting is performed, the compressive stress in the second glass portion 7 is released. Therefore, only the compressive stress in the longitudinal direction of the sealing portion 2 can be measured without cutting the lamp 1100. Consequently, the inventors quantified the compressive stress at least in this direction.

Next, the mechanism inferred by the inventors, i.e., the mechanism by which a compressive stress is applied to the second glass portion 7 of the lamp when annealing is performed on a lamp assembly at a predetermined temperature for a predetermined period of time or longer, will be described with reference to FIG. 12.

Figure 12A:
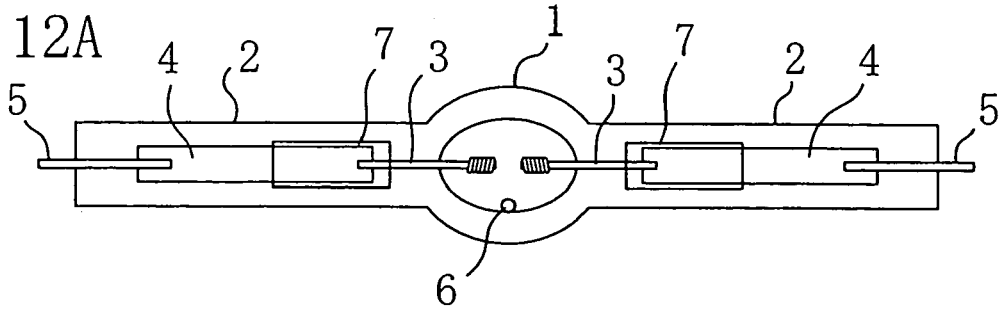
FIGS. 12A to 12D are sectional views for illustrating the mechanism by which a compressive stress is applied by annealing.

First, as shown in FIG. 12A, a lamp assembly is prepared. The lamp assembly is produced in the manner as described in the U.S. Patent Application Publications mentioned above.

Figure 12B:
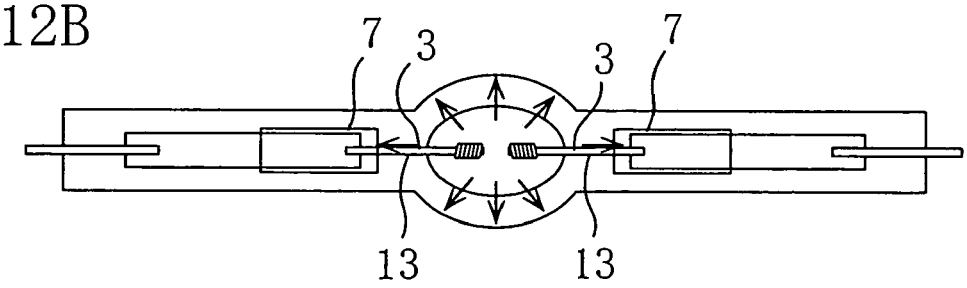

Next, when the lamp assembly is heated, as shown in FIG. 12B, mercury (Hg) 6 starts to evaporate, and as a result, a pressure is applied to the luminous bulb 1 and the second glass portion 7. The arrow in FIG. 12B indicates pressure (e.g., 100 atm or more) caused by the vapor of the mercury 6. The vapor pressure of the mercury 6 is applied not only to the inside of the luminous bulb 1 but also to the second glass portion 7 because there are gaps 13 that cannot recognized by human eyes in the sealed portion of the electrode rods 3.

The temperature for heating is further increased and heating continues at a temperature of more than the strain point of the second glass portion 7 (e.g., 1030° C.). Then, the vapor pressure of mercury is applied to the second glass portion 7 in the state where the second glass portion 7 is soft, so that a compressive stress is generated in the second glass portion 7. It is estimated that a compressive stress is generated, for example, in about four hours when heating is performed at the strain point, and in about 15 minutes when heating is performed at an annealing point. These times are derived from the definitions of the strain point and the annealing point. More specifically, the strain point refers to a temperature at which internal strain is substantially removed after four-hour storage at that temperature. The annealing point refers to a temperature at which internal stress is substantially removed after 15-minute storage at that temperature. The above estimated periods of time are derived from these facts.

Figure 12C:
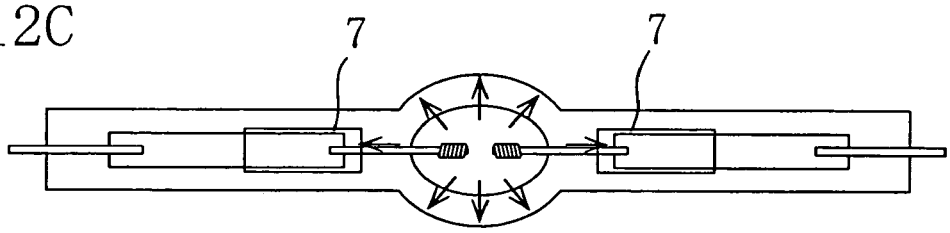
Figure 13A:
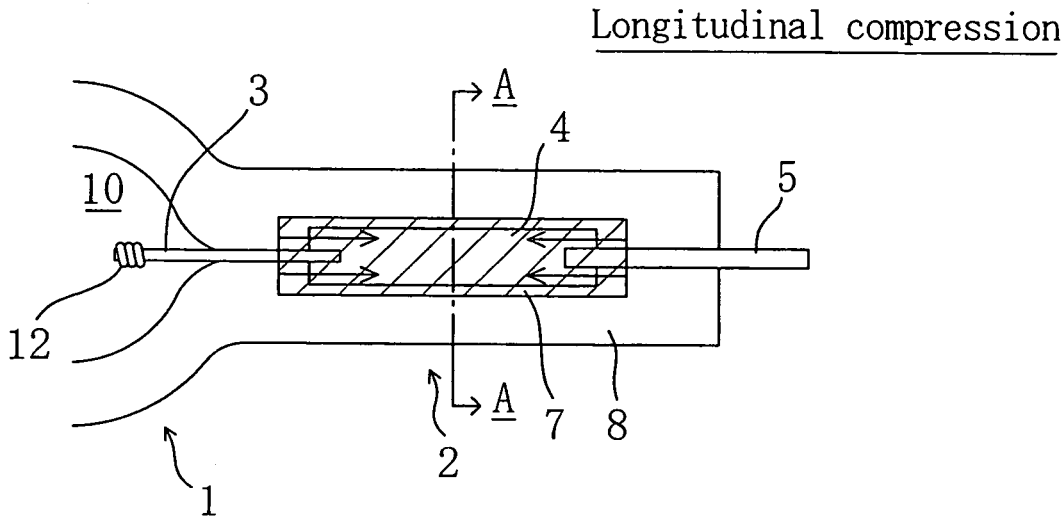
FIG. 13A is a schematic view showing a compressive stress in the longitudinal direction present in a second glass portion.
Figure 13B:
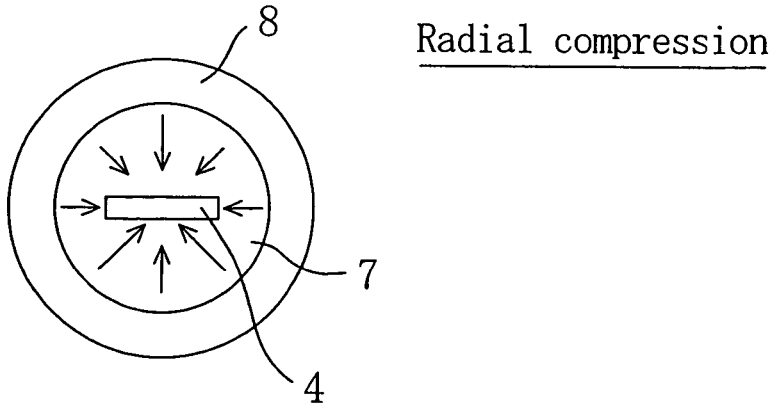
FIG. 13B is a sectional view taken along the line A-A of FIG. 13A.

Next, heating is stopped, and the lamp assembly is cooled. Even after heating is stopped, as shown in FIG. 12C, the mercury continues to evaporate. Therefore, the temperature of the second glass portion 7 is decreased to a temperature lower than the strain point with the portion 7 under the pressure by the mercury vapor. Consequently, as shown in FIGS. 13A and 13B, not only a compressive stress in the longitudinal direction but also a compressive stress in the radial or other direction of the metal foil remain in the second glass portion 7 (however, only the longitudinal compressive stress can be observed with the strain detector).

Figure 12D:
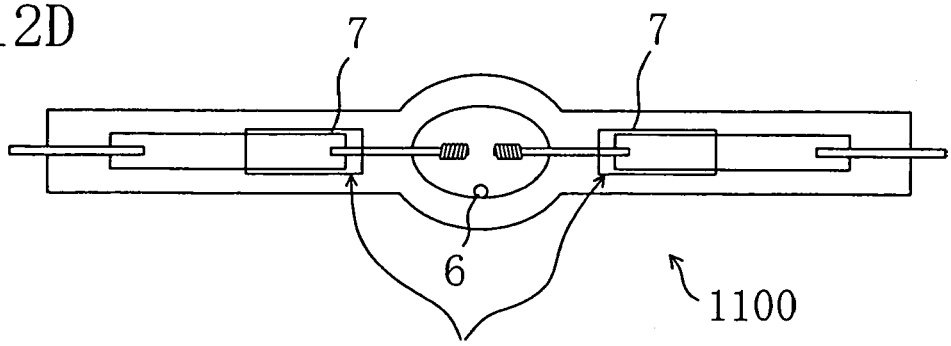

Finally, when cooling proceeds up to about room temperature, as shown in FIG. 12D, a lamp 1100 can be obtained in which a compressive stress of about 10 kgf/cm$^2$ or more is present in the second glass portion 7. Since, as shown in FIGS. 12B and 12C, the vapor pressure of the mercury is applied to both the second glass portions 7, this approach can reliably apply a compressive stress of about 10 kgf/cm$^2$ or more to both the sealing portions 2.

Figure 14:
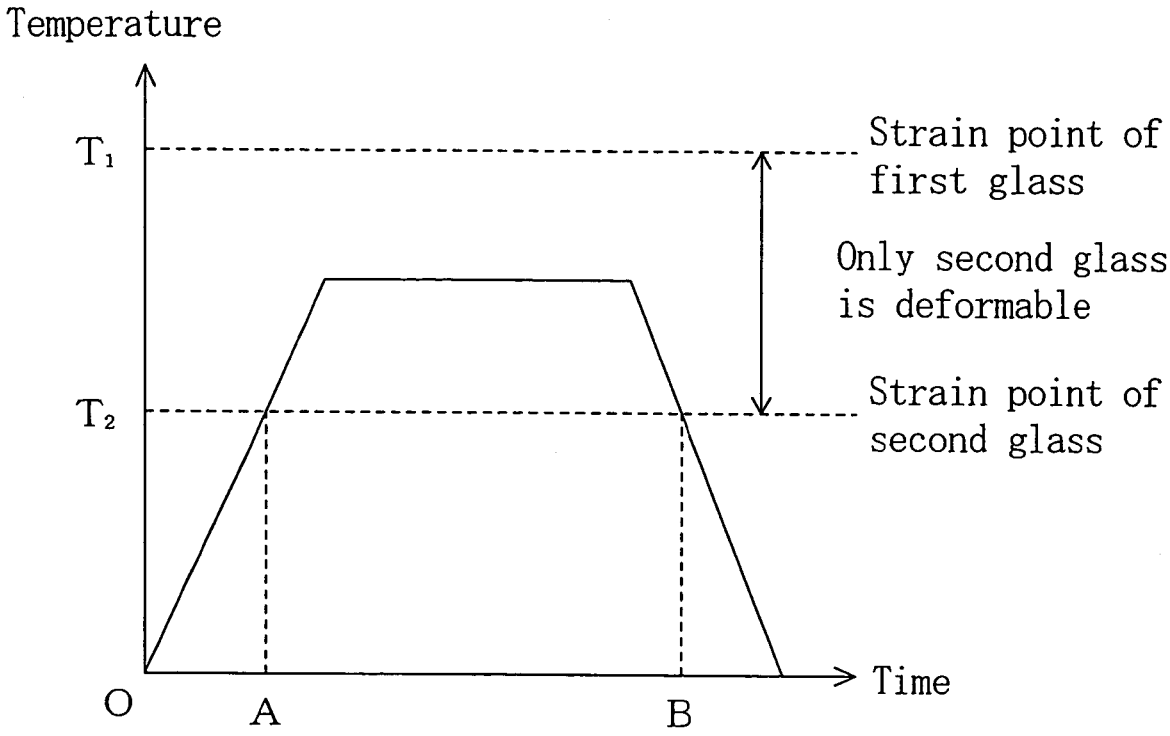
FIG. 14 is a graph schematically showing a profile of a heating process (annealing process).
Figure 15:
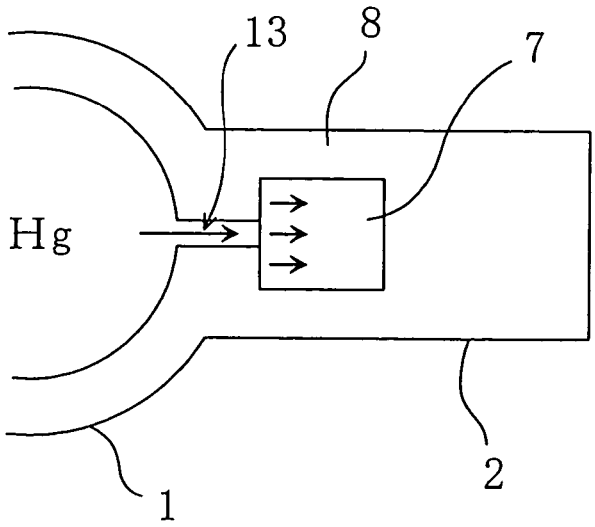
FIG. 15 is a schematic view for illustrating the mechanism by which a compressive stress is generated in the second glass portion by mercury vapor.

FIG. 14 schematically shows the profile of this heating. First, heating is started (time O), and then the lamp temperature reaches the strain point ($T_2$) of the second glass portion 7 (time A). Then, the lamp is held at a temperature between the strain point ($T_2$) of the second glass portion 7 and the strain point ($T_1$) of the first glass portion 8 for a predetermined period of time. This temperature range can basically be regarded as a range in which only the second glass portion 7 can be deformed. During the hold time, as shown in a schematic view of FIG. 15, a compressive stress is generated in the second glass portion 7 by the mercury vapor pressure (e.g., 100 atm or more).

It seems that pressure application to the second glass portion 7 using the mercury vapor pressure is the most effective approach to utilize the annealing treatment, but it can be inferred that if some force can be applied to the second glass portion 7, not only the mercury vapor pressure but also this force (e.g., pushing the external lead 5) can be used to apply a compressive stress to the second glass portion 7 as long as the lamp is held in a temperature range between $T_2$ and $T_1$ shown in FIG. 14.

Then, when heating is stopped, the lamp is gradually cooled and the temperature of the second glass portion 7 becomes lower than the strain point ($T_2$) after the passage of time B. When the temperature becomes lower than the strain point ($T_2$), the compressive stress of the second glass portion 7 remains. In this embodiment, after the lamp is held at 1030° C. for 150 hours, it is cooled (naturally cooled). Thus, a compressive stress is applied to and let to remain in the second glass portion 7.

Under the above-described mechanism, a compressive stress is generated by the mercury vapor pressure. Therefore, the magnitude of the compressive stress depends on the mercury vapor pressure (in other words, the amount of mercury enclosed).

In general, lamps tend to more readily be broken as the mercury amount is increased. However, if the sealing structure of this embodiment is used, the compressive stress is increased with the increasing mercury amount. Therefore, the vapor pressure resistance is improved. That is to say, with the structure of this embodiment, a large mercury amount realizes a higher vapor pressure resistance structure. This provides stable lamp operation at very high vapor pressure resistance that the existing techniques could not realize.

The electrode rod 3, one end of which is positioned in the discharge space, is connected by welding to the metal foil 4 provided in the sealing portion 2, and at least part of the metal foil 4 is positioned in the second glass portion 7. It is sufficient that at least part of the metal foil 4 is covered with the second glass portion 7. Specifically, in this embodiment, as shown in FIG. 13B, the second glass portion 7 covers the entire perimeter of the metal foil 4 when viewed in the transverse cross section of the sealing portion 2 (the cross section of the sealing portion 2 perpendicularly intersecting the longitudinal direction thereof). In other words, the second glass portion 7 covers the entire widthwise perimeter of at least a portion of the metal foil 4. In this portion, the edges of the metal foil 4 are surrounded with the second glass portion 7, thereby retaining a sufficient airtightness. In the structure shown in FIG. 2, a portion including a connection portion of the electrode rod 3 with the metal foil 4 is covered with the second glass portion 7. Exemplary sizes of the second glass portion 7 in the structure shown in FIG. 2 are as follows. The longitudinal dimension of the sealing portion 2 is about 2 to 20 mm (e.g., 3 mm, 5 mm or 7 mm), and the thickness of the second glass portion 7 interposed between the first glass portion 8 and the metal foil 4 is about 0.01 to 2 mm (e.g., 0.1 mm). The distance H from the end face of the second glass portion 7 closer to the luminous bulb 1 to the discharge space of the luminous bulb 1 is, for example, 0 mm to about 3 mm. The distance B from the end face of the metal foil 4 closer to the luminous bulb 1 to the discharge space of the luminous bulb 1 (in other words, the length of the portion of the electrode rod 3 that is embedded alone in the sealing portion 2) is, for example, about 3 mm.

Figure 3:
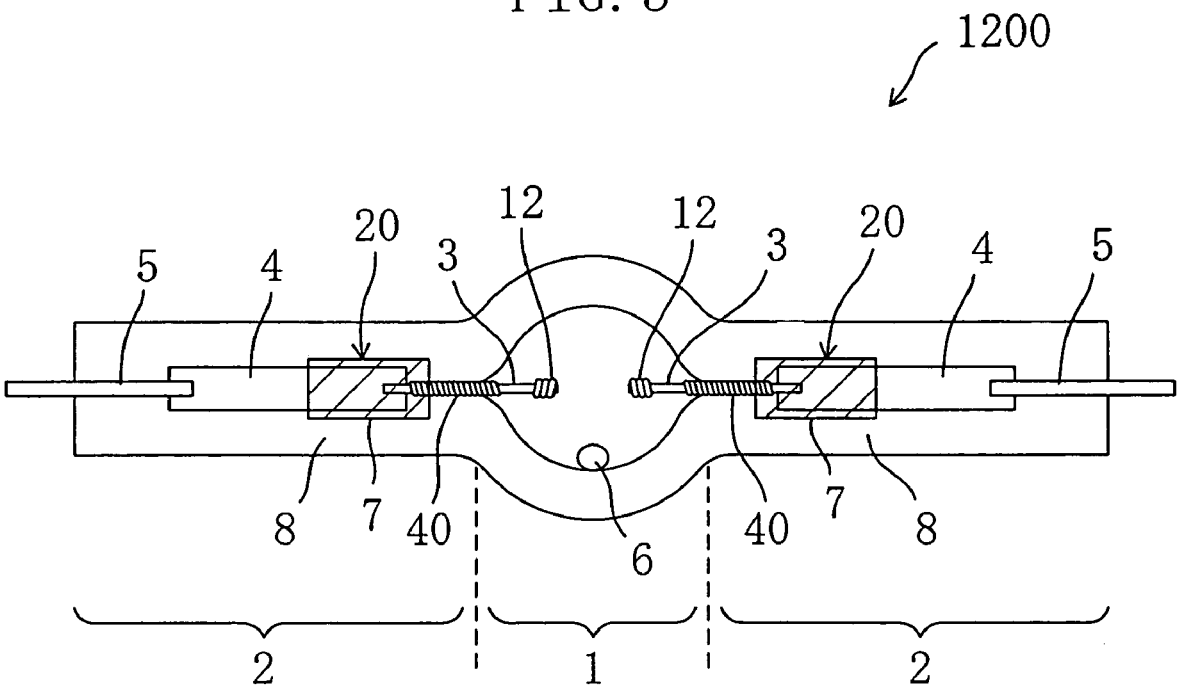
FIG. 3 is a schematic view showing the structure of a high pressure discharge lamp 1200.
Figure 4:
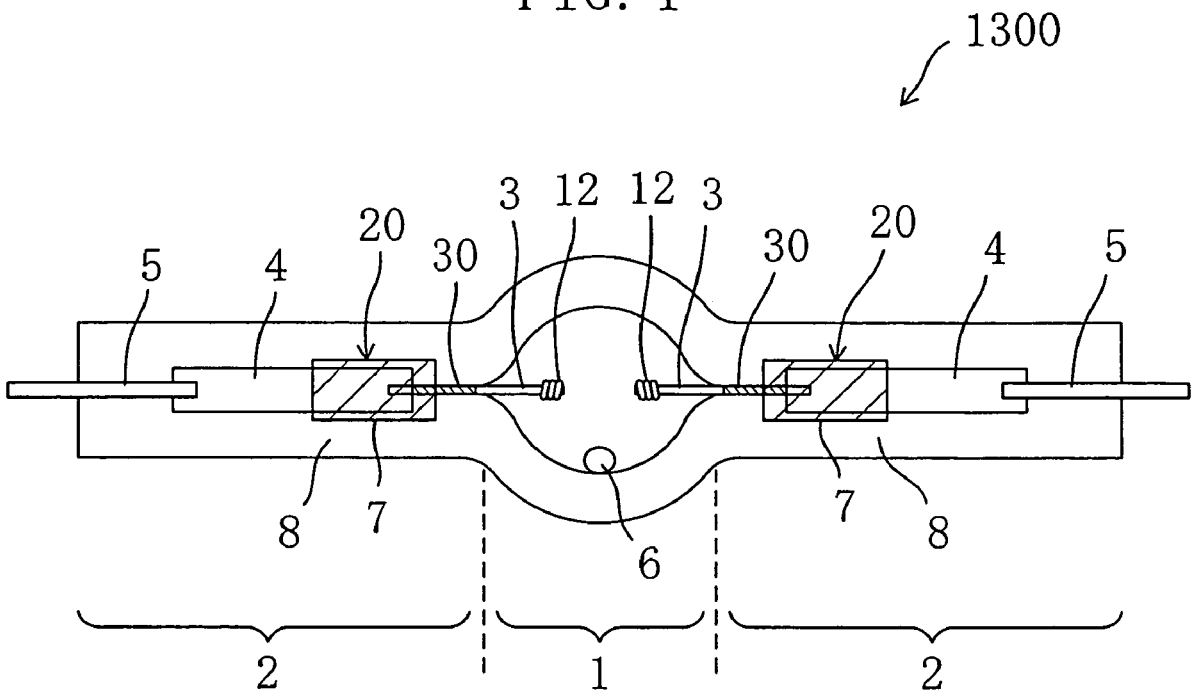
FIG. 4 is a schematic view showing the structure of a high pressure discharge lamp 1300.
Figure 5A:
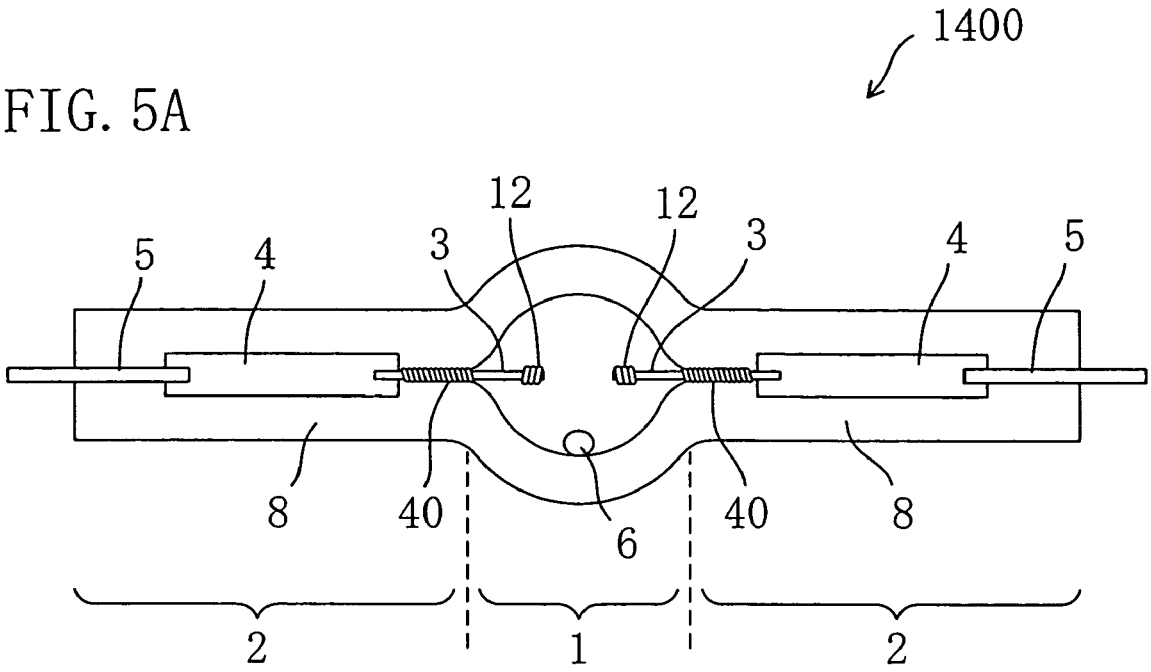
FIG. 5A is a schematic view showing the structure of a high pressure discharge lamp 1400.
Figure 5B:
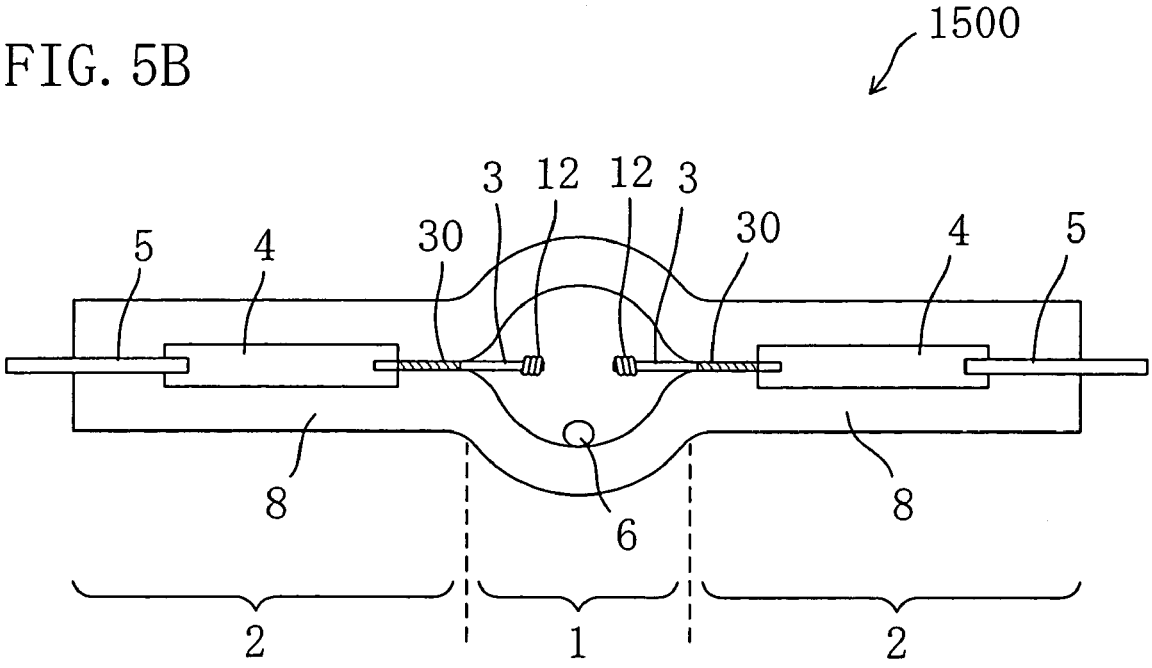
FIG. 5B is a schematic view showing the structure of a high pressure discharge lamp 1500.

The lamp 1100 shown in FIG. 2 can be modified as shown in FIG. 3. In a high pressure mercury lamp 1200 shown in FIG. 3, a portion of the electrode 3 positioned in the sealing portion 2 is wound with a coil 40 the surface of which contains at least one metal selected from the group consisting of Pt, Ir, Rh, Ru, and Re. The surface of the coil 40 used in this structure typically has a metal film with a multilayer structure in which the lower layer is an Au layer and the upper layer is a Pt layer. Like a high pressure mercury lamp 1300 shown in FIG. 4, instead of the coil 40, a metal film 30 made of at least one metal selected from the group consisting of Pt, Ir, Rh, Ru, and Re may be formed on at least part of the surface of a portion of the electrode 3 positioned in the sealing portion 2, although formation of this film causes some demerits to the production process in the case of mass production of the lamp. Even high pressure mercury lamps 1400 and 1500 not using the second glass portion 7 but using the coil 40 and the metal film 30 as shown in FIGS. 5A and 5B, respectively, can attain an operating pressure of 30 MPa or higher at a practically usable level, although their resistances against vapor pressure are lower than those of the lamps shown in FIGS. 2 to 4. However, in order to ensure a more reliable operation, the second glass portion 7 is preferably present to which a compressive stress of, e.g., about 10 kgf/cm$^2$ or greater is applied (see the structures shown in FIGS. 2 to 4).

The inventors experimentally produced a lamp, as shown FIG. 2, with an Hg vapor pressure above 30 MPa (300 atm) during burning and conducted a burning test of the lamp. Then, the inventors found from the test that if the lamp has an operating pressure of roughly 30 MPa or higher, the lamp blackens. The blackening of the lamp is caused in such a manner that the temperature of the W electrode 3 is elevated during burning and that W (tungsten) evaporating from the W electrode adheres to the inner wall of the luminous bulb. If operation of the blackened lamp is kept on in this condition, the lamp ruptures.

In such a condition that might cause blackening, if the lamp is operated at a conventional operating pressure of about 15 to 20 MPa (150 to 200 atm), halogen gas enclosed in the luminous bulb reacts with tungsten adhering to the inner wall of the luminous bulb to form tungsten halide. When tungsten halide drifts within the luminous bulb and reaches a tip 12 of the W electrode of a high temperature, it is dissociated into original halogen and tungsten. Eventually, tungsten is retuned to the tip 12 of the electrode. This phenomenon is referred to as a halogen cycle. Owing to this halogen cycle, the lamp using a conventional Hg vapor pressure can be operated without causing blackening. However, it has been found from the inventor's experiments that if the pressure is increased to 30 MPa (300 atm) or higher, this cycle cannot work well. Although it is at 30 MPa or higher that the blackening remarkably occurs, measures against the blackening have to be taken for not only the lamp of 30 MPa or higher vapor pressure but also a lamp of higher than 20 MPa vapor pressure (for example, 23 MPa or higher, or 25 MPa or higher) in order to enhance the lamp reliability for practical use.

The inventors found that transfer of heat in the upper portion of the luminous bulb 1 to the lower portion thereof can solve such a disadvantageous blackening. Thus, the present invention has been completed. Hereinafter, embodiments of the present invention will be described with reference to the accompanying drawings. It is to be noted that the present invention is not limited to the following embodiments.

First Embodiment

Figure 6:
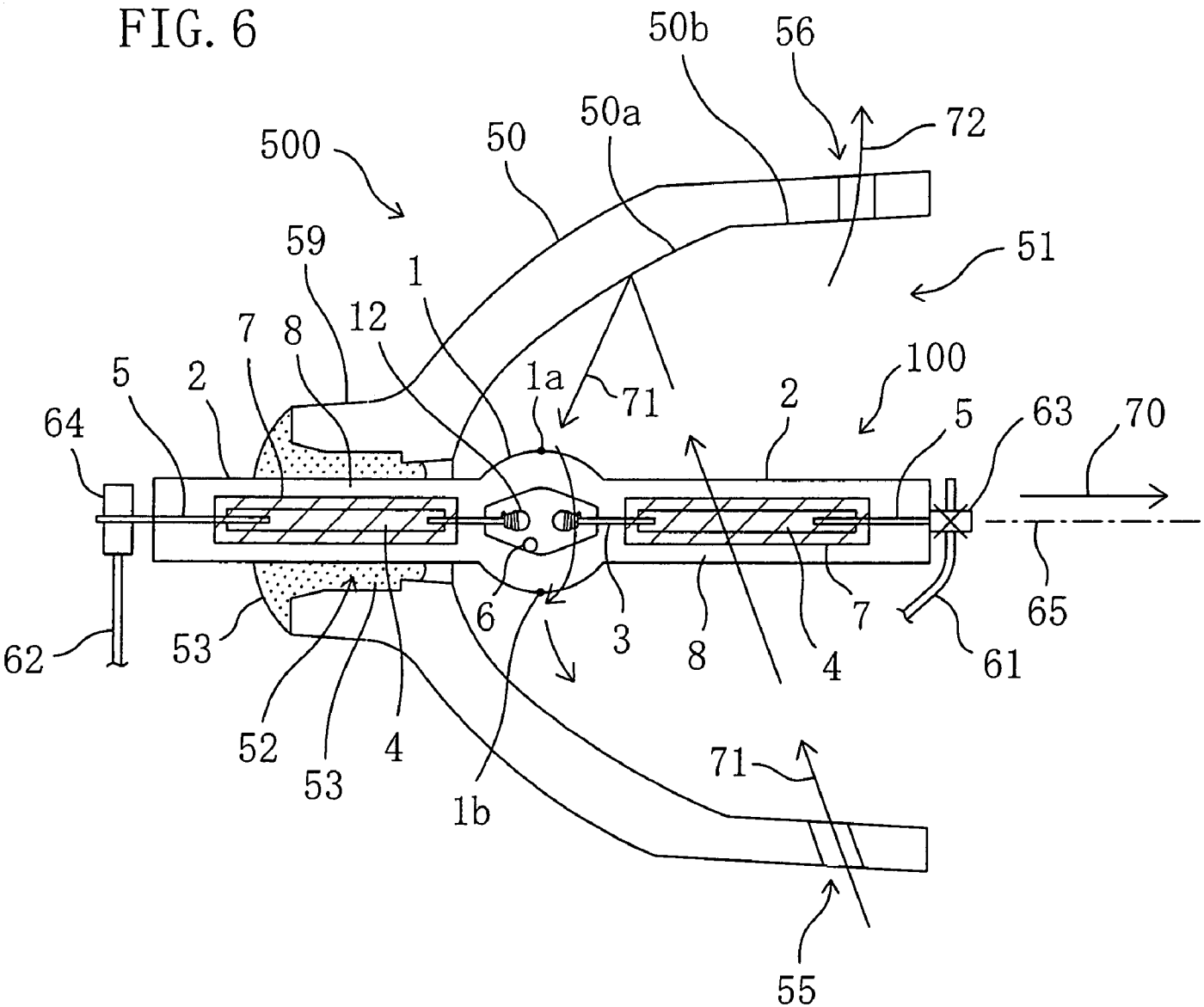
FIG. 6 is a sectional view schematically showing the structure of a lamp system 500 with a reflector according to a first embodiment of the present invention.

A first embodiment of the present invention will be described below with reference to the accompanying drawings. FIG. 6 shows a cross-sectional structure of a lamp system 500 with a reflector according to the first embodiment. For ease of viewing, hatching of the cross section is omitted from the figure.

The lamp system 500 with a reflector (referred hereinafter to as a reflector lamp system 500) shown in FIG. 6 includes a high pressure discharge lamp 100 and a reflector 50 for reflecting light emitted from the lamp 100.

The reflector 50 has a first opening (a wider opening) 51 located in a forward position of the reflector 50 with respect to a light emission direction 70. Light from the reflector lamp system 500 is emitted through the first opening 51. In a rear portion of the reflector 50 (a backward position thereof when viewed in the light emission direction 70) and in the center thereof when viewed from the front, a neck 59 is present. The neck 59 is formed with a second opening (a narrower opening) 52. A sealing portion 2 is inserted into the second opening 52 to secure the lamp 100 and the reflector 50 to each other. Clearance between the sealing portion 2 and the second opening 52 is filled with an adhesive 53. For example, the adhesive 53 is an inorganic adhesive (e.g., cement).

The high pressure discharge lamp 100 is, for example, a high pressure mercury lamp 100 in which the amount of mercury 6 enclosed is 230 mg/cm$^3$ or more. In FIG. 6, the lamp having the same structure as the lamp 1100 in FIG. 2 is shown. The lamp 1100 shown in FIG. 2 has the structure in which the second glass portion 7 covers a portion of the metal foil 4, while the lamp 100 shown in FIG. 6 has the structure in which the second glass portion 7 covers the whole of the metal foil 4. Note that the high pressure mercury lamps 1100 to 1500 shown in FIGS. 2 to 4, 5A and 5B can be employed as the high pressure mercury lamp 100.

Like the structure shown in FIG. 2 or other drawings, the high pressure mercury lamp 100 shown in FIG. 6 is provided with a luminous bulb 1 with at least mercury 6 enclosed therein and a pair of sealing portions 2 for retaining the airtightness of the luminous bulb 1. The amount of the enclosed mercury 6 is 230 mg/cm$^3$ or more (e.g., 250 mg/cm$^3$ or more, 270 mg/cm$^3$ or more, or 300 mg/cm$^3$ or more, and in some cases, more than 350 mg/cm$^3$, or 350 to 400 mg/cm$^3$ or more) based on the internal volume of the luminous bulb.

In the luminous bulb 1, a pair of electrodes (or electrode rods) 3 are opposed to each other. The electrodes 3 are connected by welding to metal foils 4, respectively. The metal foil 4 is typically a molybdenum foil and is provided within the sealing portion 2. If the lamp 1100 shown in FIG. 2 is used as the high pressure mercury lamp 100, at least a portion of the metal foil 4 is positioned in the second glass portion 7. External leads 5 are connected to respective ends of the metal foils 4. One of the external leads 5 is connected through a connection member 63 to a lead wire 61. The other of the external leads 5 is connected through a connection member 64 to a lead wire 62.

In the reflector lamp system 500 of the first embodiment, a portion of the reflector 50 is formed with an air inlet 55 for introducing an air flow (71) striking against an upper portion 1*a* of the luminous bulb 1 and then coming into a lower portion 1*b* of the luminous bulb 1. The lamp 100 is arranged so that the sealing portions 2 and 2 extend in a substantially horizontal direction. In other words, the lamp 100 is arranged so that an axis 65 of the lamp 100 (for example, the center line obtained by connecting the electrodes 3 and 3) is substantially horizontal.

With the structure of the first embodiment, the air flow (71) striking against the upper portion 1*a* of the luminous bulb 1 and then coming into the lower portion 1*b* thereof can be introduced intentionally from the air inlet 55. Therefore, the temperature of the upper portion 1*a* of the luminous bulb 1 can be decreased and the temperature of the lower portion 1*b* of the luminous bulb 1 can also be increased. As a result, the difference in temperature between the upper portion 1*a* and the lower portion 1*b* of the luminous bulb 1 can be reduced. If the air inlet 55 is absent, the temperature difference caused between the upper portion 1*a* and the lower portion 1*b* of the luminous bulb 1 creates a problem. This problem will be described later.

The structure of the first embodiment will be further described in detail. In the first embodiment, the air inlet (the first air vent) 55 is formed in a region of the reflector 50 located below the sealing portion 2 and in front of the luminous bulb 1 with respect to the light emission direction 70. Moreover, an air vent (a second air vent) 56 is formed in a region of the reflector 50 located above the sealing portion 2 and in front of the luminous bulb 1 with respect to the light emission direction 70. A duct (not shown) can be coupled to the air inlet 55. The duct is used to introduce air into the reflector 50, which makes it easy to generate the air flow (71) striking against the upper portion 1*a* of the luminous bulb 1 and then coming into the lower portion 1*b* thereof.

At least part of air introduced via the air inlet 55 strikes against and reflects from the region of the reflector 50 positioned above the sealing portion 2. The reflected air touches the upper portion 1*a* of the luminous bulb 1, and then it can move to the lower portion 1*b* of the luminous bulb 1 (see the arrow 71 in FIG. 6). Preferably, the duct (not shown) and the air inlet 55 are disposed so that such an air flow can be generated.

In the exemplary lamp shown in FIG. 6, the introduced air flow (71) is made to successfully strike to the upper portion 1*a* of the luminous bulb 1 after the reflection from the reflector 50 in such a manner that the vector of the air flow is adjusted by tilting the angle at which the air inlet 55 passes through the reflector with respect to the vertical direction. Even if the angle at which the air inlet 55 passes though is substantially vertical (substantially perpendicular), adjustment of the angle of the duct also enables generation of the air flow 71 touching the upper portion 1*a* of the luminous bulb 1 and then moving to the lower portion 1*b* thereof. As a matter of course, it is more effective to adjust both the angle of the duct and the angle at which the air inlet 55 passes through.

From the air vent 56 formed in the upper portion of the reflector 50, air in the reflector 50 is ejected. Specifically, during burning, air in the reflector 50 is heated to create convection, and then the heated air is ejected from the air vent 56 (see the arrow 72 in FIG. 6). The ejection of air from the air vent 56 brings about the effect of improving introduction of the air flow 71 from the air inlet 55. This is because, even if only an air inlet is provided, an air draft is poor as long as no air outlet is provided. Therefore, it is preferable to provide the air vent 56 in the upper portion of the reflector 50.

To the first opening 51 of the reflector 50 in the first embodiment, no front glass is attached. Therefore, it is possible to introduce and eject air also through the first opening 51. However, it is preferable to form the air vent 56 to eject heated air from the upper portion of the reflector. In the first embodiment, when the lamp 100 is disposed in a substantially horizontal attitude, the air inlet 55 and the air vent 56 are positioned in a substantially vertical direction. In other words, the air inlet 55 is formed right below the air vent 56, and the air vent 56 is formed right above the air inlet 55.

The reflector 50 has a reflecting face 50*a*. The reflecting face 50*a* has an elliptical face or a parabolic face. The reflector 50 in the first embodiment is an elliptical mirror with an elliptical face as the reflecting face 50*a*. An annular edge 50*b* of the reflector 50 is located on the circumference of the reflecting face 50*a*. Also in order to keep the effective reflection area of the reflector, it is preferable to form the air inlet 55 and/or the air vent 56 in the edge 50*b* if generation of the air flow 71 can be ensured in this formation.

The reflecting face 50*a* of the reflector 50 has a maximum diameter of, for example, 45 mm or smaller. Considering that demands for lamp downsizing are further satisfied, the reflecting face 50*a* can have a maximum diameter of 40 mm or less than 40 mm. The internal volume of the reflector 50 is, for example, 200 $cm^3$ or smaller. In the first embodiment, exemplary dimensions of the reflector 50 and the focal point thereof are as follows: the diameter Φ of the reflecting face 50*a* is about 45 mm; and the depth D of the reflector 50 is about 33 mm. Even if the reflecting face 50*a* of the reflector 50 is of circular shape when viewed from the front, the reflector lamp system 500 can be formed in rectangular shape or square shape. The volume of the reflector 50 in the first embodiment is about 40000 $mm^3$, that is, about 40 cc. In the case where the reflector 50 is of an elliptical mirror type, the distances from the deepest portion of the reflector 50 to the focal points F1 and F2 are about 8 mm and about 64 mm, respectively.

If only the air flow 71 is generated well, there is no particular limit to the shapes and the dimensions of the air inlet 55 and the air vent 56. The shapes of the air inlet 55 and the air vent 56 are, for example, substantially rectangular or substantially circular (e.g., circular, elliptical, or elongated circular). To prevent scattering of debris caused in case of rupture, a mesh or the like may be provided over the air inlet 55 and/or the air vent 56. The air inlet 55 and the air vent 56 have an area of, for example, about 50 to 800 $mm^2$.

It is also possible to attach a front glass to the first opening 51 of the reflector 50 to provide the reflector 50 of a sealing structure. Even when the reflector 50 has the sealing structure, the air inlet 55 and the air vent 56 enables generation of the air flow 71 in the reflector 50. Filling of the clearance between the second opening 53 in the neck 59 and the sealing portion 2 of the lamp 100 is preferable for a good generation of the air flow 71. Even though a gap or a hole that does not disturb the path of the air flow 71 is present in the neck 59, it can be considered that there is substantially no clearance between the second opening 53 and the sealing portion 2.

Figure 7A:
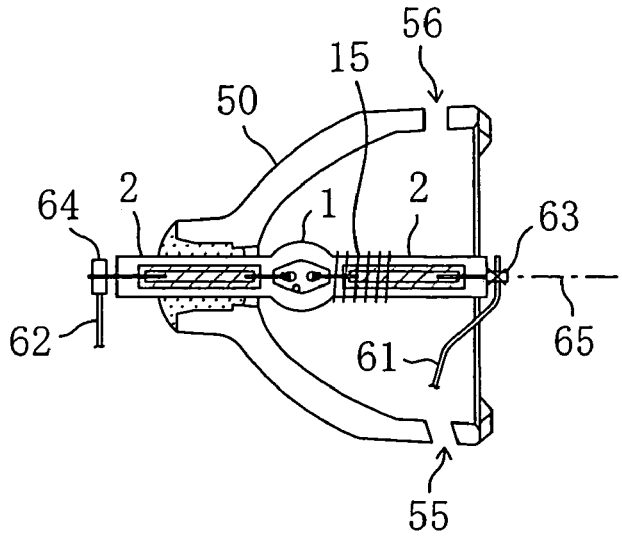
FIGS. 7A to 7C are a sectional side view, a front view, and a back view, respectively, which show the structure of the lamp system 500 with a reflector according to the first embodiment.
Figure 7B:
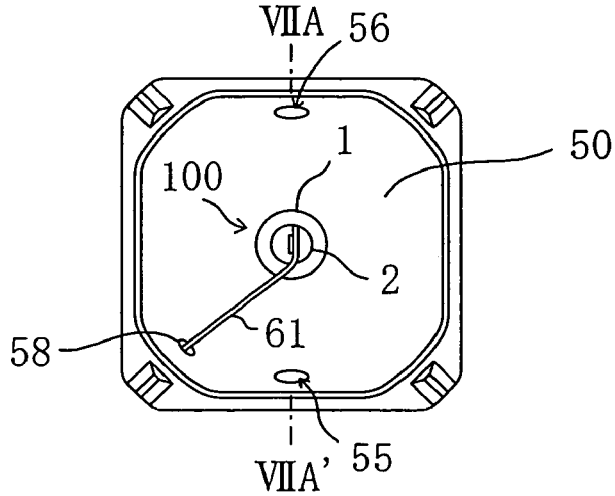
Figure 7C:
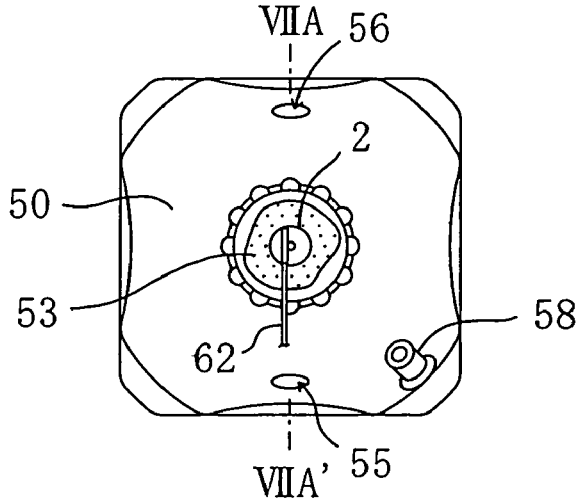

FIGS. 7A to 7C are a sectional side view, a front view, and a back view, respectively, which show the structure of the reflector lamp system 500 according to the first embodiment. Note that FIG. 7A is a sectional view taken along the line VIIA-VIIA' in FIGS. 7B and 7C. In the lamp exemplarily shown in FIG. 7, in order to improve the starting capability of the lamp, a trigger line 15 is wound around the sealing portion 2. The trigger line is a starting aid line capable of reducing the starting voltage of the lamp. As shown FIGS. 7B and 7C, a portion of the reflector 50 is formed with an opening 58 for drawing the lead wire 61 out of the reflector 50.

The structure of the lamp 100 will be described in a more detail. The lamp 100 includes the luminous bulb 1 mainly made of quartz and a pair of sealing portions (side tube portions) 2 extending from both sides of the luminous bulb 1. The lamp 100 is a double ended type lamp provided with the two sealing portions 2. The luminous bulb 1 is substantially spherical, and has an outer diameter of, for example, about 5 mm to 20 mm. The thickness of glass of the luminous bulb 1 is, for example, about 1 mm to 5 mm. The volume of the discharge space in the luminous bulb 1 is, for example, about 0.01 to 1 cc (0.01 to 1 $cm^3$). In the first embodiment, use is made of the luminous bulb 1 of about 10 mm outer diameter, about 3 mm glass thickness, and about 0.06 cc discharge space volume.

In the luminous bulb 1, a pair of electrode rods 3 are opposed to each other. The tips of the electrode rods 3 are disposed in the luminous bulb 1 with a distance (arc length) of about 0.2 to 5 mm spaced therebetween. In the first embodiment, the arc length is set at 0.5 to 1.8 mm. The lamp of the first embodiment is operated with alternating current. The sealing portion 2 has a shrunk structure formed by a shrinkage technique. The luminous bulb 1 encloses, for example, 230 mg/cc or more of mercury 6 as a luminous species. In the first embodiment, the amount of mercury enclosed is 270 to 300 mg/cc. Alternatively, 300 mg/cc or more of mercury can be enclosed therein. In addition, rare gas (for example, argon (Ar)) of 5 to 40 kPa and, if necessary, halogen of a small amount are also enclosed therein. In the first embodiment, Ar of 20 kPa is enclosed and halogen is introduced as $CH_2Br_2$ into the luminous bulb 1. The amount of $CH_2Br_2$ enclosed is about 0.0017 to 0.17 mg/cc, which corresponds to about 0.01 to 1 μmol/cc in terms of the halogen atom density during burning. This vale is about 0.1 μmol/cc in the first embodiment. The bulb wall load placed on the inner wall of the luminous bulb during burning is, for example, 60 $W/cm^2$ or more. In the first embodiment, the lamp is operated at 120 W and has a bulb wall load of about 150 $W/cm^2$.

Next description will be made of the blackening in lamp burning at an extremely high operating pressure and the difference in temperature between the upper portion 1*a* and the lower portion 1*b* of the luminous bulb 1.

It was found by the inventors for the first time that a lamp blackens at an operating pressure of 30 MPa or higher during burning. This results exclusively from the fact that a practically usable lamp with an operating pressure of 30 MPa or more has not conventionally existed.

At this point of time, a clear reason for the blackening of the lamp with an operating pressure of 30 MPa or higher during burning is unknown. Because of this unknownness, the inventors actually tried various measures and ideas for preventing the blackening. For example, it was confirmed that a lamp with an operating pressure of 30 MPa or higher has a much higher lamp temperature (particularly luminous bulb temperature) than a lamp with an operating pressure of 15 to 20 MPa. The inventors supposed from this confirmation that the temperature elevation of the luminous bulb caused the blackening. Then, the inventors tried reducing the temperature of the luminous bulb by cooling the bulb during burning, but this could not prevent the blackening. Although other ideas were tried, none of them could successfully prevent the blackening. However, based on the idea of heating the luminous bulb 1 on the contrary, the inventors elevated the temperature of the luminous bulb 1 in a certain experiment. Incredibly, this successfully prevented the blackening. Inferring from this successful experiment, the blackening is probably prevented because of the following reason.

The lamp with an operating pressure of 30 MPa or higher during burning encloses a larger amount of Hg as a luminous species than usual. Therefore, the number of times electrons emitted from the electrode collide with Hg atoms in that lamp increases as compared to a lamp with an operating pressure of 20 MPa during burning, and the frequency of excitation of Hg also increases. The electron mobility in the lamp of 30 MPa or higher decreases, so that an arc of that lamp is narrower than that of the lamp of 20 MPa. As a result, the energy of the arc per unit volume becomes larger, and a higher intensity, higher temperature arc is generated in the lamp of 30 MPa. This arc elevates the temperature of the tip of the electrode 3 and evaporates a greater amount of tungsten than the lamp of 20 MPa. Moreover, in the lamp, there are many Hg ions drawn by a cathode and sputtering the electrode, which also contributes to an increase in the amount of evaporated tungsten. Therefore, the lamp with an operating pressure of 30 MPa or higher has a higher arc temperature and larger amounts of drifting Hg and tungsten than the lamp with an operating pressure of 20 MPa. Consequently, convection occurring in the luminous bulb 1 grows larger than the lamp of 20 MPa and then a larger amount of tungsten is carried to the inner wall of the luminous bulb 1.

Furthermore, in the lamp with an operating pressure of 30 MPa or higher during burning, a greater amount of radiant heat than the lamp with an operating pressure of 20 MPa during burning is released from the arc, which disturbs heat balance in the luminous bulb which is kept in the lamp of 20 MPa. This disturbance will be described below additionally with reference to FIG. 8.

Figure 8:
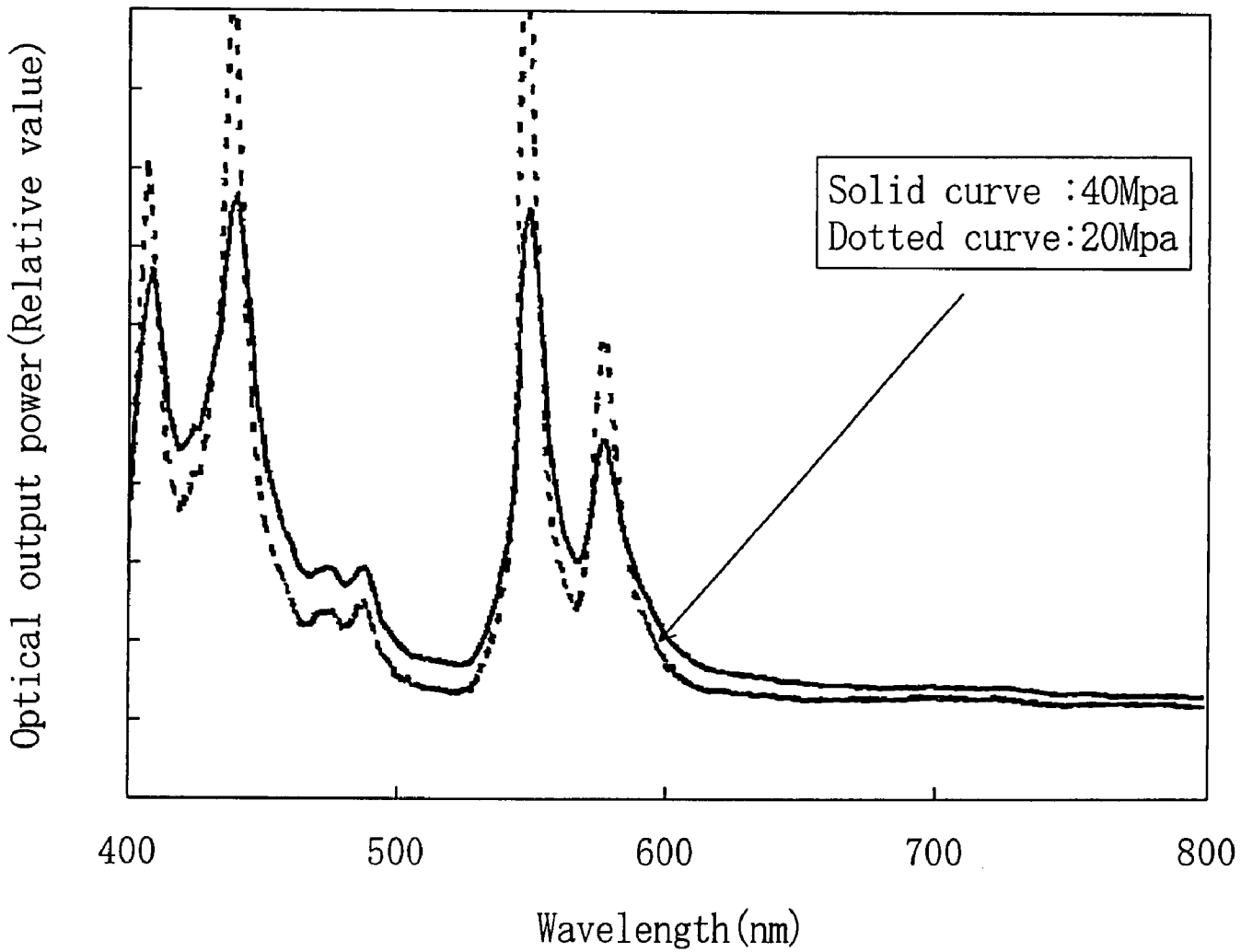
FIG. 8 is a chart showing spectra of lamps with operating pressures of 20 MPa and 40 MPa.

FIG. 8 shows spectra of the lamps with operating pressures of 20 MPa and 40 MPa during burning. As shown in FIG. 8, light emission in the infrared range increases as the operating pressure is raised. Thus, a greater amount of radiant heat is released from the arc of the lamp with a higher operating pressure. This means that a greater amount of radiant heat widens the temperature gap between a region sensitive to the radiant heat from the arc and a region insensitive thereto. As a result, temperature balance in the luminous bulb which can be kept in the luminous bulb of the lamp with an operating pressure of 20 MPa is disturbed in the lamp with an operating pressure of 30 MPa. Moreover, convection occurring in the luminous bulb 1 grows large and heat is carried from the lower portion of the luminous bulb 1 to the upper portion thereof Therefore, temperature balance is disturbed also between the upper and lower portions.

The condition as described above happens in the lamp with an operating pressure of 30 MPa, which disturbs the heat balance in the lamp. Therefore, it is inferred that in this lamp, tungsten adhering to the inner wall of the luminous bulb 1 cannot be returned to the electrode by utilizing the halogen cycle, resulting in the blackening. In one experiment conducted by the inventors, some of lamps to which the structure of the first embodiment is not applied had the following values. The temperature of the upper portion of the luminous bulb 1 was 1080° C., the lower portion thereof was 830° C., and the temperature difference between the two portions was as wide as 250° C.

The inventors found that a positive control of the temperature of the luminous bulb 1 can suppress the blackening of the lamp. Within the range of design modification acceptable to an actual product, however, it is difficult to reduce the temperature difference between the upper portion and the lower portion of the luminous bulb 1 while the lamp in the reflector lamp system is heated. To solve this difficulty, the present invention applies an approach in which the air flow (71) striking against the upper portion 1*a* of the luminous bulb 1 and then coming into the lower portion 1*b* of the luminous bulb 1 is intentionally introduced through the air inlet 55 into the reflector 50 of the reflector lamp system 500 and in which the air flow carries heat of the upper portion 1*a* of the luminous bulb 1 to the lower portion 1*b* of the luminous bulb 1. In the present invention, this approach suppresses the occurrence of blackening of the lamp. With the structure of the first embodiment of the present invention, introduction of the air flow 71 allows the temperature of the upper portion of the luminous bulb 1 to reach 950° C. and the temperature of the lower portion thereof to reach 940° C. In addition, it turned out that the lower portion of the luminous bulb 1 can have a higher temperature than the upper portion thereof (the relation between the temperatures of the upper and lower portions can be reversed) if some conditions are adjusted.

In the experiments described above, it was confirmed that blackening occurred in the lamp with an operating pressure of 30 MPa or higher. To ensure for a longer period of time no occurrence of blackening in a lamp with an operating pressure of 30 MPa or lower and higher than 20 MPa (in other words, a lamp with an operating pressure above a conventional operating pressure of 15 to 20 MPa, such as a lamp of 23 MPa or higher, 25 MPa or higher, or 27 MPa or higher), it is desirable as an actual approach that the structure of the first embodiment be employed to suppress the blackening. To be more specific, when lamps are mass-produced, inevitable variation would be caused in the lamp characteristics. Therefore, even if the lamp under production is a lamp with an operating pressure of about 23 MPa during burning, one or a few lamps that will blacken might be produced. To ensure a reliable prevention of this possible blackening, it is desirable to employ the structure of the first embodiment for the lamp with an operating pressure above a conventional operating pressure of 15 to 20 MPa. As a matter of fact, the blackening has a greater influence as the operating pressure is increased, that is, the blackening has a greater influence on the lamp of 40 MPa than on the lamp of 30 MPa. Thus, it goes without saying that the technical approach of the first embodiment has a greater technical significance in suppression of blackening of the lamp with a higher operating pressure.

With the first embodiment, a portion of the reflector 50 can be formed with the air inlet 55 for introducing the air flow 71 striking against the upper portion 1*a* of the luminous bulb 1 and coming into the lower portion 1*b* thereof, and the introduced air flow 71 can reduce the temperature difference between the upper portion 1*a* of the luminous bulb 1 and the lower portion 1*b* thereof. This suppresses the occurrence of blackening even when the high pressure mercury lamp 100 is operated at a higher operating pressure (for example, 23 MPa or higher, or 27 MPa or higher) than a conventionally used high operating pressure (for example, 15 to 20 MPa).

Second Embodiment

Figure 9:
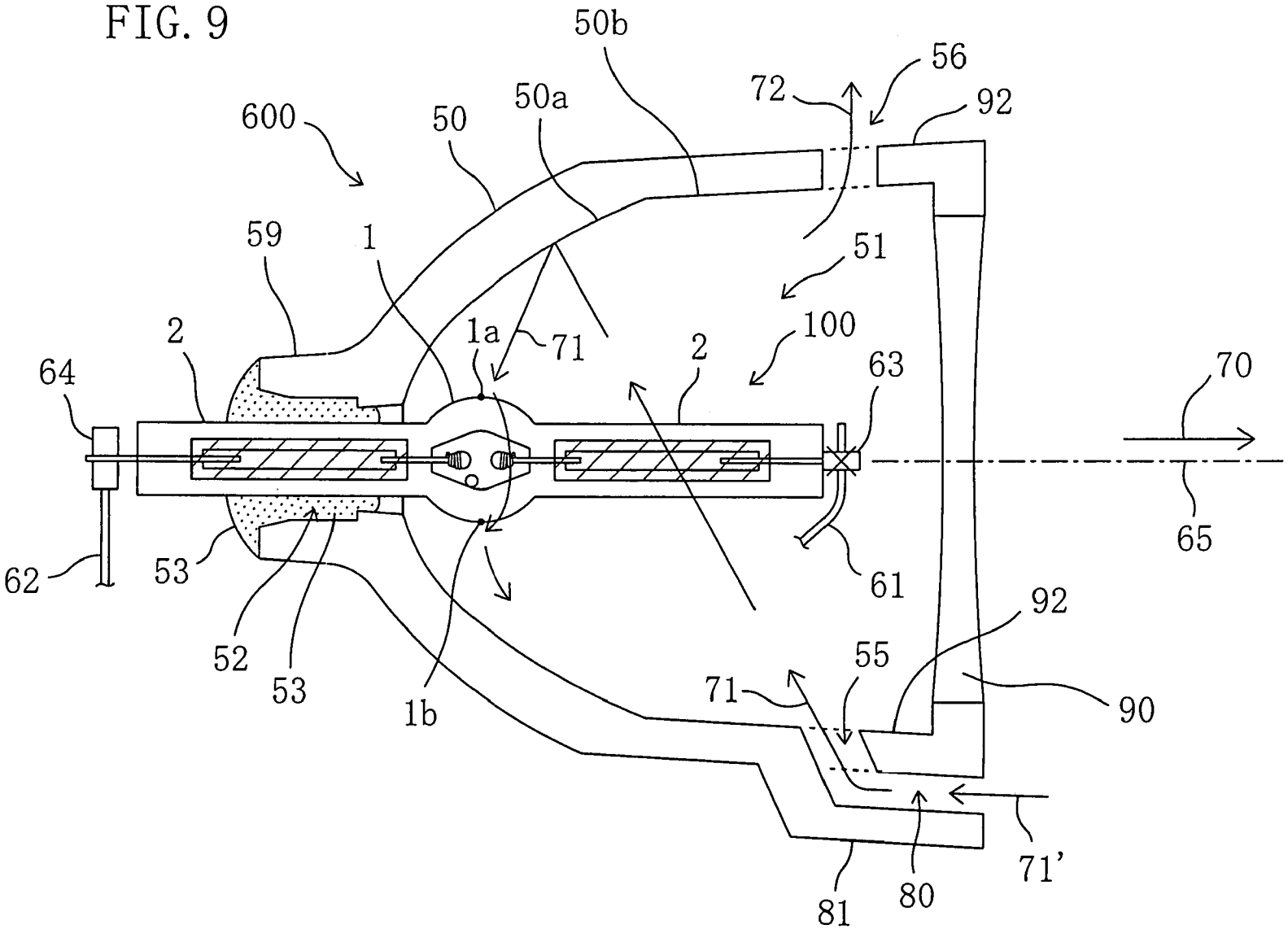
FIG. 9 is a sectional view schematically showing the structure of a lamp system 600 with a reflector according to a second embodiment of the present invention.

Next, a second embodiment of the present invention will be described with reference to FIG. 9. The structure of the second embodiment is made by modifying the structure of the first embodiment, in which similarly to the first embodiment, the introduced air flow 71 can reduce the temperature difference between the upper portion 1*a* of the luminous bulb 1 and the lower portion 1*b* thereof.

In a lamp system 600 with a reflector (referred hereinafter to as a reflector lamp system 600) shown in FIG. 9, a duct 80 capable of introducing air into the lamp is coupled to the air inlet 55. The duct 80 is integrally formed in the reflector lamp system 600. When an air 71' is introduced from the outside into the duct 80, the air having passed through the duct 80 in turn passes through the air inlet 55 and then reaches, as the air flow 71, around the internal face (50*a*) of the reflector 50. The air flow suitably mixes a warm air positioned in the upper portion and a less warm air positioned in the lower portion with each other, thereby eliminating temperature nonuniformity. Part (or in some cases, almost all) of the air flow 71 reflects from the internal face (50*a*) of the reflector 50 (or moves along the internal face of the reflector 50) and then touches the upper portion 1*a* of the luminous bulb 1 to carry heat of the upper portion 1*a* of the luminous bulb 1 to the lower portion 1*b* thereof.

A front glass 90 is attached to a portion of the reflector 50 in front of the first opening 51. The front glass 90 is fixed by a supporting member 92 to the reflector 50. In the second embodiment, a portion of the supporting member 92 is formed with the air inlet 55, and another portion of the supporting member 92 is formed with the air vent 56. The supporting member 92 in the second embodiment is made of resin, which brings about a big advantage because it is easier to form the air inlet 55 and/or the air vent 56 by molding than bore a hole or holes through the reflector 50.

In some cases, even though the air inlet 55 and/or the air vent 56 is formed through not the reflector 50 but another member such as the supporting member 92, the air inlet 55 and/or the air vent 56 is regarded, for convenience, as being formed through a portion of the reflector 50. That is to say, in some case, the reflector 50 can be regarded as including the supporting member 92. This is because if the reflector 50 is thus regarded, no particular problem arises from whether or not the edge 50*b* in the first embodiment is formed of the same material as the reflecting face 50*a*.

Moreover, in the structure of the second embodiment, a duct member 81 for forming the duct 80 is attached to the reflector 50 together with the supporting member 92 and the supporting member 92 and the duct member 81 constitute the duct 80. By this structure, the supporting member 92 and the duct 80 can be formed in the same process. The duct 80 and the reflector 50 may not be integrally formed, and alternatively a duct in hose-like shape may be attached to the air inlet 55.

In the second embodiment, a concave lens is used for the front glass 90. The concave lens contributes to actual realization of the lamp 100 serving as a smaller point light source in the reflector lamp system 600. This will be described in more detail. When the lamp 100 in the reflector 50 is observed through the concave lens 90, the lamp 100 looks small. This means that the light emission point of the lamp 100 (the light emission region where the arc is positioned) substantially becomes small. That is to say, this means that the lamp serving as a smaller point light source can be attained. As the lamp 100 becomes a smaller point light source, the light efficiency of an image projection apparatus using this lamp is enhanced as is preferable.

Figure 10:
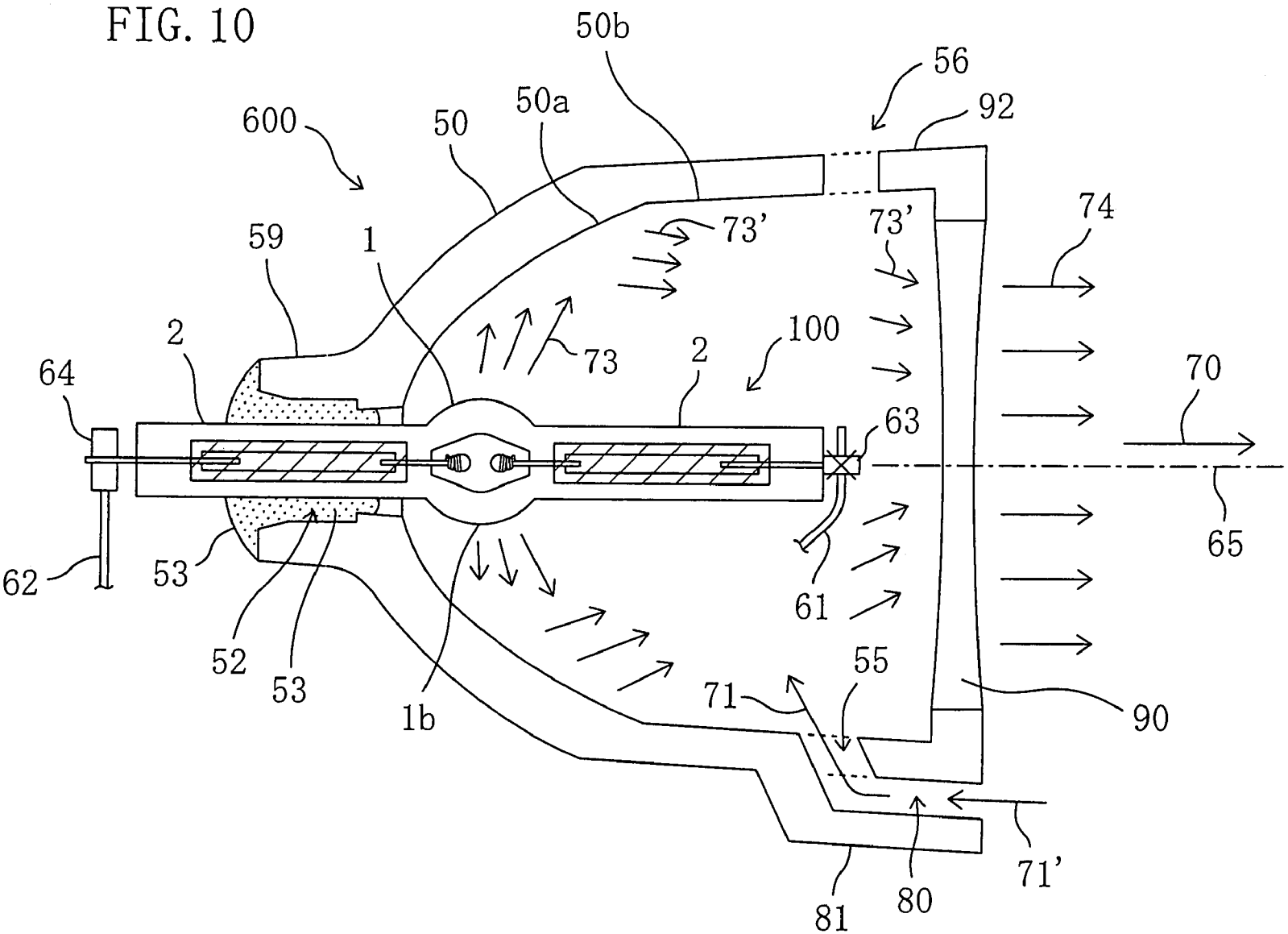
FIG. 10 is a sectional view schematically showing the structure of the lamp system 600 with a reflector according to the second embodiment of the present invention.

In the case where the reflector 50 of the reflector lamp system 600 is an elliptical mirror, the lamp system 600 has the light emission mechanism as shown FIG. 10. Specifically, light 73 emitted from the luminous bulb (a luminous portion) 1 of the lamp 100 reflects from the reflecting face 50*a* of the reflector 50 (the arrow 73'), and then travels to the concave lens 90 (to be more precise, the light 73 travels to converge toward the focal point). Then, the light 73 passes through the concave lens 90 and is emitted as parallel light 74.

Attachment of the supporting member 92 and the front glass (the concave lens) 90 can provide the sealing structure of the lamp system 600 other than the air inlet 55 and the air vent 56. If the sealing structure can be applied, scattering of debris to the outside can be prevented in event of possible rupture. In order to prevent the debris from scattering also from the air vent 56, it is preferable to arrange a mesh or the like over the air vent 56. In the structure shown in FIG. 9, the air inlet 55 is connected through the duct 80 to the outside, so that it does not come into a direct contact with to the outside. Therefore, it is also possible to apply a design in which no mesh or the like is arranged over the air inlet 55.

In the structure of the second embodiment, the concave lens 90 is attached to the reflector lamp system 600, so that the lamp serving as a smaller point light source can be practically attained. This makes it possible to enhance the light efficiency of the lamp.

The structures and the characteristics of the first and second embodiments are appropriately applicable to each other. In addition, since blackening of the high pressure mercury lamp is the problem that should be avoided for all lamps using an operating pressure above a conventional operating pressure of 15 to 20 MPa, the technical approaches of the embodiments of the present invention applied to the lamp 100 are widely applicable not only to the lamps 1100 to 1500 shown in FIGS. 2 to 5 but also to other lamps having an excellent vapor pressure resistance property and an operating pressure above 20 MPa (such as a lamp of 23 MPa or higher, in particular, a lamp of 27 MPa or higher, or 30 MPa or higher)

The relation between the halogen density and the temperature of the luminous bulb also has an influence on the blackening of the lamp in the embodiments. In consideration of this relation, if, for example, $CH_2Br_2$ is selected as halogen to be enclosed, it is preferable to enclose $CH_2Br_2$ at about 0.0017 to 0.17 mg/cc per the internal volume of the luminous bulb. In other words, it is preferable to enclose $CH_2Br_2$ at about 0.01 to 1 μmol/cc in terms of the halogen atom density. This is because of the following fact. If the amount of enclosed $CH_2Br_2$ is smaller than 0.01 μmol/cc, most of the halogen is allowed to react with impurities in the lamp. This substantially prevents the halogen cycle from working. On the other hand, if the amount of enclosed $CH_2Br_2$ is greater than 1 μmol/cc, the pulse voltage necessary at lamp start-up rises, which is impractical. In the case of using a ballast circuit capable of applying a high voltage, however, this limitation is not applied. More preferably, the amount of enclosed $CH_2Br_2$ is 0.1 to 0.2 μmol/cc. The reason is as follows. Even if various circumstances in producing the lamps causes some variation in the amount of enclosed $CH_2Br_2$, this variation can fall within the range capable of working the halogen cycle as long as the amount is 0.1 to 0.2 μmol/cc. Therefore, this amount is more preferable.

If the lamp 100 in the embodiments has a bulb wall load of 80 W/cm$^2$ or more, the temperature of the bulb wall of the luminous bulb is sufficiently elevated and all mercury enclosed evaporates. Therefore, the following approximate expression holds: the amount of enclosed mercury per internal volume of the luminous bulb: 400 mg/cc=the operating pressure during burning: 40 MPa. If the amount of enclosed mercury is 300 mg/cc in this case, the operating pressure during burning is 30 MPa. On the other hand, if the bulb wall load is less than 80 W/cm$^2$, the condition occurs in which the temperature of the luminous bulb cannot be elevated to the temperature capable of evaporating mercury. In this condition, the above approximate expression may not hold. Therefore, the lamp with a bulb wall load of less than 80 W/cm$^2$ cannot have a desired operating pressure in many cases, and is not suitable for a light source for a projector in many cases because light emission particularly in the red range decreases.

An image projection apparatus can be formed by combining the reflector lamp system in the above-described embodiments with an optical system including an image device (a DMD (Digital Micromirror Device) panel or a liquid crystal panel). For example, projectors (digital light processing™ (DLP) projectors) using a DMD or liquid crystal projectors (including reflective projectors using a LCOS (Liquid Crystal on Silicon) structure) can be provided. Furthermore, the lamp system in the embodiments can be used suitably not only as a light source of an image projection apparatus but also for other applications. For example, the lamp can be used for a light source for an ultraviolet ray stepper, a light source for a sport stadium, a light source for an automobile headlight, or a floodlight for illuminating a traffic sign.

In the above embodiments, a mercury lamp using mercury as a luminous substance has been described as one example of a high pressure discharge lamp, but the present invention can be applied to any metal halide lamps having the structure in which the sealing portions (seal portions) maintain the airtightness of the luminous bulb. The metal halide lamp is a high pressure discharge lamp enclosing a metal halide. In recent years, mercury-free metal halide lamps with no mercury enclosed have been under development, and the above embodiments can be applied to mercury-free metal halide lamps.

An exemplary mercury-free metal halide lamp is a lamp having the structure shown in FIG. 6 or other drawings, but not substantially enclosing mercury and enclosing at least a first halide, a second halide and rare gas. The metal constituting the first halide is a luminous material. The second halide has a vapor pressure higher than the first halide and is a halide of one or more metals that emit light in a visible light region with more difficulty than the metal constituting the first halide. For example, the first halide is a halide of one or more metals selected from the group consisting of sodium, scandium, and rare earth metals. The second halide has a relatively larger vapor pressure and is a halide of one or more metals that emit light in a visible light region with more difficulty than the metal constituting the first halide. More specifically, the second halide is a halide of at least one metal selected from the group consisting of Mg (magnesium), Fe (iron), Co (cobalt), Cr (chromium), Zn (zinc), Ni (nickel), Mn (manganese), Al (aluminum), Sb (antimony), Be (beryllium), Re (rhenium), Ga (gallium), Ti (titanium), Zr (zirconium), and Hf (hafnium). The second halide containing at least Zn halide is more preferable.

Another combination example is as follows. In a mercury-free metal halide lamp including a translucent luminous bulb (airtight vessel) 1, a pair of electrodes 3 provided in the luminous bulb 1, and a pair of sealing portions 2 coupled to the luminous bulb 1, $ScI_3$ (scandium iodide) and NaI (sodium iodide) as luminous materials, $InI_3$ (indium iodide) and TlI (thallium iodide) as alternative materials to mercury, and rare gas (e.g., Xe gas of 1.4 MPa) as starting aid gas are enclosed in the luminous bulb 1. In this case, $ScI_3$ (scandium iodide) and NaI (sodium iodide) constitute the first halide, and $InI_3$ (indium iodide) and TlI (thallium iodide) constitutes the second halide. The second halide can be any halide as long as it has a comparatively high vapor pressure and can serve as an alternative to mercury. Therefore, for example, Zn iodide can be used instead of $InI_3$ (indium iodide).

Up to this point, the present invention has been described by using the preferable embodiments. However, the description above is not limiting, and various modifications can be made.

Figure 1:
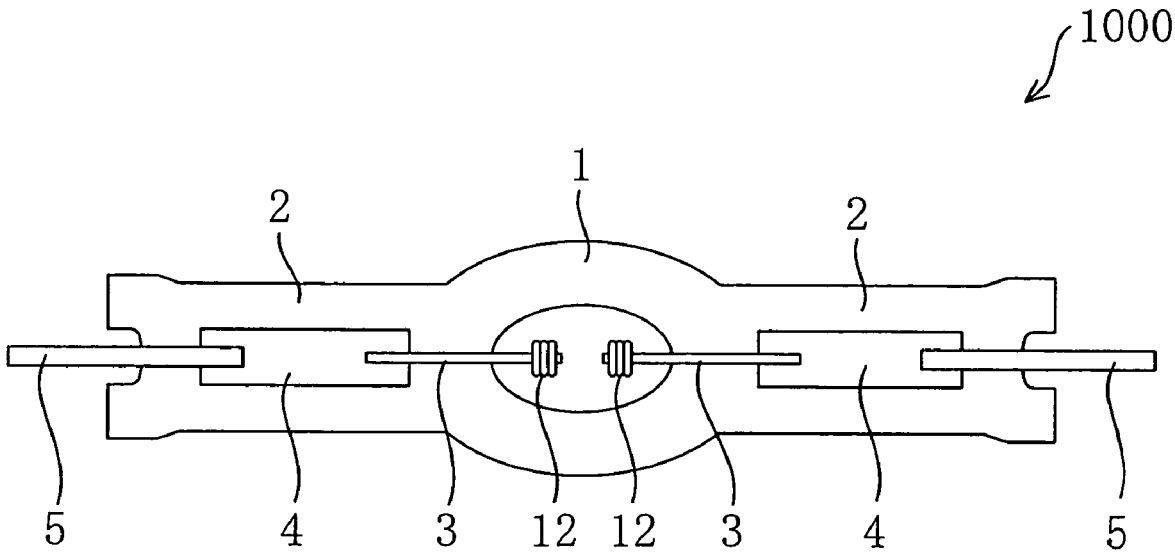
FIG. 1 PRIOR ART
FIG. 1 is a schematic view showing the construction of a conventional high pressure mercury lamp 1000.

Japanese Unexamined Patent Publication No. 2-148561 discloses the lamp (see FIG. 1) having an Hg vapor pressure of 200 to 350 bars (corresponding to about 20 to 35 MPa). From the study by the inventors, it is proved that if the disclosed lamps are operated at an operating pressure of 30 MPa or higher, several tens or more percent of the lamps break within the first six hours of burning. Within much longer, 2000 hours of burning that lamps on a practical level demand, more of the lamps would conceivably break. Accordingly, it is difficult in actuality for the lamp with the structure shown in FIG. 1 to attain an operating pressure of 30 MPa or higher on the practical level.

The lamp with a reflector according to the present invention has the air inlet for introducing an air flow striking against the upper portion of the luminous bulb and then coming into the lower portion thereof. The air flow introduced from the air inlet can adjust the temperature difference between the upper and lower portions of the luminous bulb of the high pressure discharge lamp. This enables suppression of blackening of a high pressure discharge lamp with an operating pressure above 20 MPa (for example, 23 MPa or higher, or in particular, 25 MPa or higher (or 27 MPa or higher, or 30 MPa or higher)).

What is claimed is:

1. A lamp with a reflector, comprising:

a high pressure discharge lamp including a luminous bulb with a luminous substance enclosed therein and a pair of sealing portions extending from the luminous bulb; and a reflector for reflecting light emitted from the high pressure discharge lamp, wherein the reflector has a first opening located in a forward position of the reflector with respect to a light emission direction, the reflector is formed with a second opening into which one of the pair of sealing portions is inserted, and clearance between the one said sealing portion and the second opening is substantially filled, at least one of the pair of sealing portions includes a first glass portion extending from the luminous bulb and a second glass portion provided in at least a portion of the inside of the first glass portion, and the at least one said sealing portion has a portion to which a compressive stress is applied, and when the pair of sealing portions are disposed to extend in the substantially horizontal direction, a part of a region of the reflector located below the sealing portion is formed with an air inlet for introducing an air flow striking against an upper portion of the luminous bulb and then coming into a lower portion of the luminous bulb.

2. The lamp of claim 1, wherein the high pressure discharge lamp is a high pressure mercury lamp, and mercury is enclosed as the luminous substance in an amount of 230 $mg/cm^3$ or more based on the internal volume of the luminous bulb.

3. A lamp with a reflector, comprising:

a high pressure mercury lamp including a luminous bulb with at least mercury enclosed therein and a pair of sealing portions extending from the luminous bulb; and a reflector for reflecting light emitted from the high pressure mercury lamp, wherein the reflector has a first opening located in a forward position of the reflector with respect to a light emission direction, the reflector is formed with a second opening into which one of the pair of sealing portions is inserted, and clearance between the one said sealing portion and the second opening is substantially filled, each of the pair of sealing portions includes a first glass portion extending from the luminous bulb and a second glass portion provided in at least a portion of the inside of the first glass portion, and both the pair of sealing portions have portions to which a compressive stress is applied, when the pair of sealing portions are disposed to extend in the substantially horizontal direction, an air inlet is formed in a region of the reflector located below the sealing portion and in front of the luminous bulb with respect to the light emission direction, and an air vent is formed in a region of the reflector located above the sealing portion and in front of the luminous bulb with respect to the light emission direction, a duct for passing air is coupled to the air inlet, and the air inlet and the air vent are arranged so that the air is introduced through the air inlet toward the high pressure mercury lamp and is ejected from the air vent.

4. The lamp of claim 3, wherein the duct and the air inlet are arranged so that at least part of air introduced from the duct via the air inlet strikes against and reflects from a region of the reflector positioned above the sealing portion, the reflected air touches the upper portion of the luminous bulb, and then the air moves to the lower portion of the luminous bulb.

5. The lamp of claim 1 wherein a concave lens is further attached to a position of the reflector located in front of the first opening with respect to the light emission direction.

6. The lamp of claim 3, wherein a concave lens is further attached to a position of the reflector located in front of the first opening with respect to the light emission direction.

7. The lamp of claim 1, wherein at least mercury is enclosed as the luminous substance in the luminous bulb, the amount of the enclosed mercury is 270 $mg/cm^3$ or more based on the internal volume of the luminous bulb, halogen is enclosed in the luminous bulb, and the lamp has a bulb wall load of 80 $W/cm^2$ or more.

8. The lamp of claim 3, wherein the amount of the enclosed mercury is 270 $mg/cm^3$ or more based on the internal volume of the luminous bulb, halogen is enclosed in the luminous bulb, and the lamp has a bulb wall load of 80 $W/cm^2$ or more.

9. The lamp of claim 7, wherein the amount of the enclosed mercury is 300 $mg/cm^3$ or more based on the internal volume of the luminous bulb.

10. The lamp of claim 8, wherein the amount of the enclosed mercury is 300 $mgl/cm^3$ or more based on the internal volume of the luminous bulb.

11. The lamp of claim 1, wherein in the luminous bulb, electrode rods are opposed to each other, each of the electrode rods is connected to a metal foil, and the metal foil is provided in the sealing portion and at least a portion of the metal foil is positioned in the second glass portion.

12. The lamp of claim 3, wherein in the luminous bulb, electrode rods are opposed to each other, each of the electrode rods is connected to a metal foil, and the metal foil is provided in the sealing portion and at least a portion of the metal foil is positioned in the second glass portion.

13. The lamp of claim 11 wherein a coil at least the surface of which contains at least one metal selected from the group consisting of Pt, Ir, Rh, Ru, and Re is wound around at least part of a portion of the electrode rod embedded in the sealing portion.

14. The lamp of claim 12, wherein a coil at least the surface of which contains at least one metal selected from the group consisting of Pt, Ir, Rh, Ru, and Re is wound around at least part of a portion of the electrode rod embedded in the sealing portion.

15. The lamp of claim 1, wherein a metal portion which comes into contact with the second glass portion and which is used for supply of power is provided in the sealing portion, the compressive stress is applied in at least the longitudinal direction of the sealing portion, the first glass portion contains 99 wt % or more of $SiO_2$, and the second glass portion contains $SiO_2$ and at least one of 15 wt % or less of $Al_2O_3$ and 4 wt % or less of B.

16. The lamp of claim 3, wherein a metal portion which comes into contact with the second glass portion and which is used for supply of power is provided in the sealing portion, the compressive stress is applied in at least the longitudinal direction of the sealing portion, the first glass portion contains 99 wt % or more of $SiO_2$, and the second glass portion contains $SiO_2$ and at least one of 15 wt % or less of $Al_2O_3$ and 4 wt % or less of B.

17. The lamp of claim 1.

wherein the compressive stress in a region of the sealing portion corresponding to the second glass portion is from 10 $kgf/cm^2$ to 50 $kgf/cm^2$ inclusive when the sealing portion is measured by a sensitive color plate method utilizing the photoelastic effect.

18. The lamp of claim 3, wherein the compressive stress in a region of the sealing portion corresponding to the second glass portion is from 10 $kgf/cm^2$ to 50 $kgf/cm^2$ inclusive when the sealing portion is measured by a sensitive color plate method utilizing the photoelastic effect.

19. The lamp of claim 1 wherein the duct and the air inlet are arranged so that at least part of air introduced from the duct via the air inlet strikes against and reflects from a region of the reflector positioned above the sealing portion, the reflected air touches the upper portion of the luminous bulb, and then the air moves to the lower portion of the luminous bulb, the reflector is an elliptical mirror, and a concave lens is attached to a position of the reflector located in front of the first opening with respect to the light emission direction.

20. The lamp of claim 3, wherein the duct and the air inlet are arranged so that at least part of air introduced from the duct via the air inlet strikes against and reflects from a region of the reflector positioned above the sealing portion, the reflected air touches the upper portion of the luminous bulb, and then the air moves to the lower portion of the luminous bulb, the reflector is an elliptical mirror, and a concave lens is attached to a position of the reflector located in front of the first opening with respect to the light emission direction.

21. The lamp of claim 1, wherein a trigger line is wound around at least one of the pair of sealing portions.

22. The lamp of claim 3, wherein a trigger line is wound around at least one of the pair of sealing portions.

23. An image projection apparatus comprising:

the lamp with a reflector of claim 1; and an optical system using the lamp with a reflector as a light source.

24. An image projection apparatus comprising:

the lamp with a reflector of claim 3; and an optical system using the lamp with a reflector as a light source.

25. The lamp of claim 1, wherein the angle at which the air inlet passes through the reflector is tilted with respect to the vertical direction so that the air inlet introduces the air flow striking against the upper portion of the luminous bulb and then coming in to the lower portion of the luminous bulb.

26. The lamp of claim 4, wherein an angle at which the air inlet passes through the reflector is tilted with respect to the vertical direction, and/or a direction in which the duct extends is tilted with respect to the horizontal direction.

* * * * *

UNITED STATES PATENT AND TRADEMARK OFFICE

CERTIFICATE OF CORRECTION

PATENT NO. : 7,230,382 B2
APPLICATION NO. : 10/828493
DATED : June 12, 2007
INVENTOR(S) : Makoto Horiuchi et al.

It is certified that error appears in the above-identified patent and that said Letters Patent is hereby corrected as shown below:

Column 21

Line 38, Claim 10, "mgl/cm$^3$" should be -- mg/cm$^3$ --

Signed and Sealed this

Thirtieth Day of October, 2007

JON W. DUDAS
*Director of the United States Patent and Trademark Office*